US011046572B2

(12) United States Patent
Edwards et al.

(10) Patent No.: US 11,046,572 B2
(45) Date of Patent: Jun. 29, 2021

(54) BEER DISPENSER

(71) Applicants: Robert Edwards, Kitchener (CA); Mohan Pandit, London (CA)

(72) Inventors: Robert Edwards, Kitchener (CA); Mohan Pandit, London (CA)

(73) Assignee: Robert Edwards, Kitchener (CA)

( * ) Notice: Subject to any disclaimer, the term of this patent is extended or adjusted under 35 U.S.C. 154(b) by 0 days.

(21) Appl. No.: 16/713,840

(22) Filed: Dec. 13, 2019

(65) Prior Publication Data

US 2020/0231426 A1 Jul. 23, 2020

Related U.S. Application Data

(60) Provisional application No. 62/779,152, filed on Dec. 13, 2018.

(51) Int. Cl.

*B67D 1/12* (2006.01)
*B67D 1/14* (2006.01)
*B67D 1/08* (2006.01)

(52) U.S. Cl.

CPC ..... *B67D 1/127* (2013.01); *B67D 1/0882* (2013.01); *B67D 1/0888* (2013.01); *B67D 1/1411* (2013.01)

(58) Field of Classification Search

CPC .... B67D 1/1411; B67D 1/127; B67D 1/1275; B67D 1/0882; B67D 1/1238; B67D 2001/1263

USPC ..... 141/263, 270, 275, 276, 279, 284; 137/170.1

See application file for complete search history.

(56) References Cited

U.S. PATENT DOCUMENTS 4,437,497 A * 3/1984 Enander ..... B65B 3/26 137/386
4,458,735 A * 7/1984 Houman ..... B67D 1/124 141/198
4,733,381 A * 3/1988 Farmer ..... B67D 1/1238 141/198
5,115,841 A * 5/1992 Horino ..... B67D 1/06 141/250
5,538,054 A * 7/1996 L uhmann ..... B67C 3/007 141/198
5,775,387 A * 7/1998 Kaneko ..... B65B 39/004 141/146
5,921,293 A * 7/1999 Berger ..... B65B 3/22 141/192
6,082,419 A * 7/2000 Skell ..... B67D 1/1238 141/198
6,100,518 A * 8/2000 Miller ..... G01B 11/02 141/1
6,155,312 A * 12/2000 Bosy ..... B43K 7/04 141/18
6,189,578 B1 * 2/2001 Clusserath ..... B67C 3/10 141/293

(Continued)

*Primary Examiner* — Timothy L Maust
(74) *Attorney, Agent, or Firm* — Bereskin & Parr LLP/S.E.N.C.R.L., s.r.l.

(57) ABSTRACT

A beer dispenser having a nozzle for positioning above a container and dispensing beer into the container. The dispenser includes at least one imaging device for generating at least one image of the dispensed beer, and a processor. The processor determines a measured foam height and a liquid upper surface from the at least one image of the dispensed beer, and adjusts a distance between the nozzle and the liquid upper surface as the beer is dispensed to control the measured foam height.

17 Claims, 35 Drawing Sheets

(56) References Cited

U.S. PATENT DOCUMENTS

| | | | | |
|---|---|---|---|---|
| 7,546,854 | B2 * | 6/2009 | Ozanne | B67D 1/1238 141/198 |
| 8,167,004 | B2 * | 5/2012 | Lee | G01F 23/2962 141/198 |
| 8,695,646 | B2 * | 4/2014 | Agam | G01S 7/527 141/95 |
| 10,829,362 | B2 * | 11/2020 | Chernov | B67D 1/0888 |
| 10,858,235 | B2 * | 12/2020 | Jung | B01D 35/04 |

* cited by examiner

BEER DISPENSER

RELATED APPLICATIONS

This application claims the benefit of U.S. Provisional Patent Application Ser. No. 62/779,152, filed Dec. 13, 2018, the entire contents of which are hereby incorporated by reference herein for all purposes.

FIELD

The systems and methods disclosed herein generally relate to the field of dispensing beverages.

INTRODUCTION

Excessive foaming often occurs during the pouring of beers, either because flow rates from the draught system are improperly manipulated by the server at the source, or the glass is not placed/angled properly while pouring. Many servers under-pour beer 'head' resulting in an effective over-pour of beer, while others will over-pour large quantities of beer into the drain to correct a large foam imbalance.

During peak service hours, pouring beer can become a bottleneck. Due to the manual nature of pouring beer, a server is often limited to one glass at a time. Moreover, some establishments offer samplers (4-6 oz glasses), which result in a higher margin for the brewery but often further delays the time from order to table-side delivery. Many establishments often hire extra bartenders to help pour beer and speed service, resulting in added labor costs. Others simply avoid a higher margin, smaller volume because of the logistical challenges.

It is estimated than anywhere from 15-20% of beer from draught lines is lost from spillage, over pours, and pilferage. One of the challenges of business owners is dealing with theft of product, or under-the-table selling of beer by employees to customers. Currently, few systems track metrics of sale directly at the source. The current systems that track pours do not address the challenges of quality and time.

SUMMARY OF VARIOUS EMBODIMENTS

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures In one aspect, a beer dispenser is provided having: a nozzle for positioning above a container and dispensing beer into the container; at least one imaging device for generating at least one image of the dispensed beer; and a processor. The processor is configured to: determine a measured foam height and a liquid upper surface from the at least one image of the dispensed beer; and adjust a distance between the nozzle and the liquid upper surface as the beer is dispensed to control the measured foam height.

The processor may be further configured to determine a difference between the measured foam height and a desired foam height; and adjust the distance between the nozzle and the liquid upper surface as the beer is dispensed to reduce the difference between the measured foam height and the desired foam height.

In accordance with this aspect, the beer dispenser may also include an elevation system for adjusting the distance between the nozzle and the liquid upper surface.

In accordance with this aspect, the beer dispenser may also include a support for receiving the container.

In accordance with this aspect, the elevation system may be coupled to the support for adjusting the distance between the nozzle and the liquid upper surface by changing the position of the support.

In accordance with this aspect, the elevation system may be coupled to both the nozzle and the support for changing the distance between the nozzle and the liquid upper surface of the beer by changing the position of at least one of the nozzle and the support.

In accordance with this aspect, the beer dispenser may also include a flow measurement device for measuring the volume of the dispensed beer.

In accordance with this aspect, the processor may be further configured to calculate a volume of the dispensed beer using the at least one image generated by the at least one imaging device.

In accordance with this aspect, the beer dispenser may also include a position sensor for determining a distance between the nozzle and a container bottom.

In accordance with this aspect, the beer dispenser may also include a rim sensor for determining a position a container rim.

In accordance with this aspect, the beer dispenser may also include a second nozzle for dispensing beer into a second container.

In accordance with this aspect, the beer dispenser may also include a first nozzle and a second nozzle and the second nozzle dispenses a different beer than the beer dispensed by the first nozzle.

In accordance with this aspect, the beer dispenser may also include a memory for storing the desired foam height for at least one type of beer.

In accordance with this aspect, the beer dispenser may also include at least one light source for illuminating the beer dispenser.

In accordance with this aspect, the processor may be further configured to determine a position of a container rim from the at least one image; calculate a distance between the container rim and the liquid upper surface; and cease dispensing the beer when the distance between the container rim and the liquid upper surface reaches a threshold.

In accordance with this aspect, the beer dispenser may also include at least one imaging device having at least one of an ultrasound sensor, an infrared sensor, and a camera.

In accordance with this aspect, the processor may be further configured to use at least one of a neural network and a computer vision algorithm to determine at least one of the measured foam height and the liquid upper surface.

In another aspect, there is provided a beverage dispenser having: a nozzle for positioning above a container and dispensing a beverage into the container; at least one imaging device for generating at least one image of the dispensed beverage; and a processor. The processor is configured to: determine a measured foam height and a liquid upper surface from the at least one image of the dispensed beverage; and adjust a distance between the nozzle and the liquid upper surface as the beverage is dispensed to control the measured foam height.

In accordance with this aspect, the processor may be further configured to: determine a difference between the measured foam height and a desired foam height; and adjust the distance between the nozzle and the liquid upper surface as the beverage is dispensed to reduce the difference between the measured foam height and the desired foam height.

In accordance with this aspect, the beer dispenser may include an elevation system for adjusting the distance between the nozzle and the liquid upper surface.

In accordance with this aspect, there is provided a beverage dispenser having a support for receiving the container.

In accordance with this aspect, the elevation system may be coupled to the nozzle for adjusting the distance between the nozzle and the liquid upper surface by changing the position of the nozzle.

In accordance with this aspect, the elevation system may be coupled to the support for adjusting the distance between the nozzle and the liquid upper surface by changing the position of the support.

In accordance with this aspect, the elevation system may be coupled to both the nozzle and the support for changing the distance between the nozzle and the liquid upper surface of the beverage by changing the position of at least one of the nozzle and the support.

In accordance with this aspect, the beverage dispenser may have a flow measurement device for measuring the volume of the dispensed beverage.

In accordance with this aspect, the beverage dispenser may have a position sensor for determining a distance between the nozzle and a container bottom.

In accordance with this aspect, the beverage dispenser may have a rim sensor for determining a position of a container rim.

In accordance with this aspect, the beverage dispenser may have a second nozzle for dispensing beverage into a second container.

In accordance with this aspect, the nozzle may include a first nozzle and a second nozzle and the second nozzle may dispense a different beverage than the beverage dispensed by the first nozzle.

In accordance with this aspect, the beverage dispenser may have a memory for storing the desired foam height for at least one type of beverage.

In accordance with this aspect, the beverage dispenser may have at least one light source for illuminating the beverage dispenser.

In accordance with this aspect, the processor may be further configured to determine a position of a container rim from the at least one image; calculate a distance between the container rim and the liquid upper surface; and cease dispensing the beverage when the distance between the container rim and the liquid upper surface reaches a threshold.

In accordance with this aspect, the at least one imaging device may include at least one of an ultrasound sensor, an infrared sensor, and a camera.

In accordance with this aspect, the processor may be further configured to calculate a volume of the dispensed beverage using the at least one image generated by the at least one imaging device.

In accordance with this aspect, the processor may be further configured to use at least one of a neural network and a computer vision algorithm to determine at least one of the measured foam height and the liquid upper surface.

In another aspect, there is provided a method for dispensing beer using a beer dispenser. The method includes positioning a nozzle above a container; dispensing beer from the nozzle into the container; generating at least one image of the dispensed beer using at least one imaging device; determining a measured foam height from the at least one image of the dispensed beer; determining a liquid upper surface from the at least one image of the dispensed beer; and adjusting a distance between the nozzle and the liquid upper surface as the beer is dispensed to control the measured foam height.

In accordance with this aspect, the method may include determining a difference between the measured foam height and a desired foam height; and adjusting the distance between the nozzle and the liquid upper surface as the beer is dispensed to reduce the difference between the measured foam height and the desired foam height.

In accordance with this aspect, the method may include using an elevation system to adjust the distance between the nozzle and the liquid upper surface.

In accordance with this aspect, the method may include using a support to receive the container.

In accordance with this aspect, the method may include adjusting the distance between the nozzle and the liquid upper surface by changing the position of the nozzle with the elevation system.

In accordance with this aspect, the method may include adjusting the distance between the nozzle and the liquid upper surface by changing the position of the support with an elevation system.

In accordance with this aspect, the method may include adjusting the distance between the nozzle and the liquid upper surface by changing at least one of the position of the support and the nozzle with the elevation system.

In accordance with this aspect, the method may include measuring the volume of the dispensed beer using a flow measurement device.

In accordance with this aspect, the method may include determining a distance between the nozzle and a container bottom using a position sensor.

In accordance with this aspect, the method may include determining a position of a container rim using a rim sensor.

In accordance with this aspect, the method may include dispensing beer through a second nozzle.

In accordance with this aspect, the method may include dispensing a different beer through the second nozzle.

In accordance with this aspect, the method may include storing the desired foam height using a memory device.

In accordance with this aspect, the method may include illuminating the beer dispenser using at least one light source.

In accordance with this aspect, the method may include: determining a position of a container rim from the at least one image; calculating a distance between the container rim and the liquid upper surface; and ceasing the dispensing of beer when the distance between the container rim and the liquid upper surface reaches a threshold.

In accordance with this aspect, the method may include generating an image of the dispensed beer using at least one of an ultrasound sensor, an infrared sensor, and a camera.

In accordance with this aspect, the processor may calculate a volume of the dispensed beverage using the at least one image generated by the at least one imaging device.

In accordance with this aspect, the processor may use at least one of a neural network and a computer vision algorithm to determine at least one of the measured foam height and the liquid upper surface.

In another aspect, there is provided a beverage dispenser having: a nozzle for positioning above a container and dispensing a beverage into the container; at least one imaging device for generating at least one image of the dispensed beverage; and a processor. The processor is configured to determine a measured beverage characteristic and a liquid upper surface from the at least one image of the dispensed beverage; and adjust a distance between the nozzle and the liquid upper surface as the beverage is dispensed to control the measured beverage characteristic.

In accordance with this aspect, the processor may be further configured to: determine a difference between the measured beverage characteristic and a desired beverage characteristic; and adjust the distance between the nozzle and the liquid upper surface as the beverage is dispensed to reduce the difference between the measured beverage characteristic and the desired beverage characteristic.

In another aspect, there is provided a beverage dispenser having: a nozzle for positioning above a container and dispensing a beverage into the container; at least one imaging device for generating at least one image of the dispensed beverage; and a processor. The processor is configured to determine a liquid upper surface from the at least one image of the dispensed beverage and adjust a flow rate from the nozzle to control the liquid upper surface.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

DETAILED DESCRIPTION OF THE EMBODIMENTS

Figure 1:
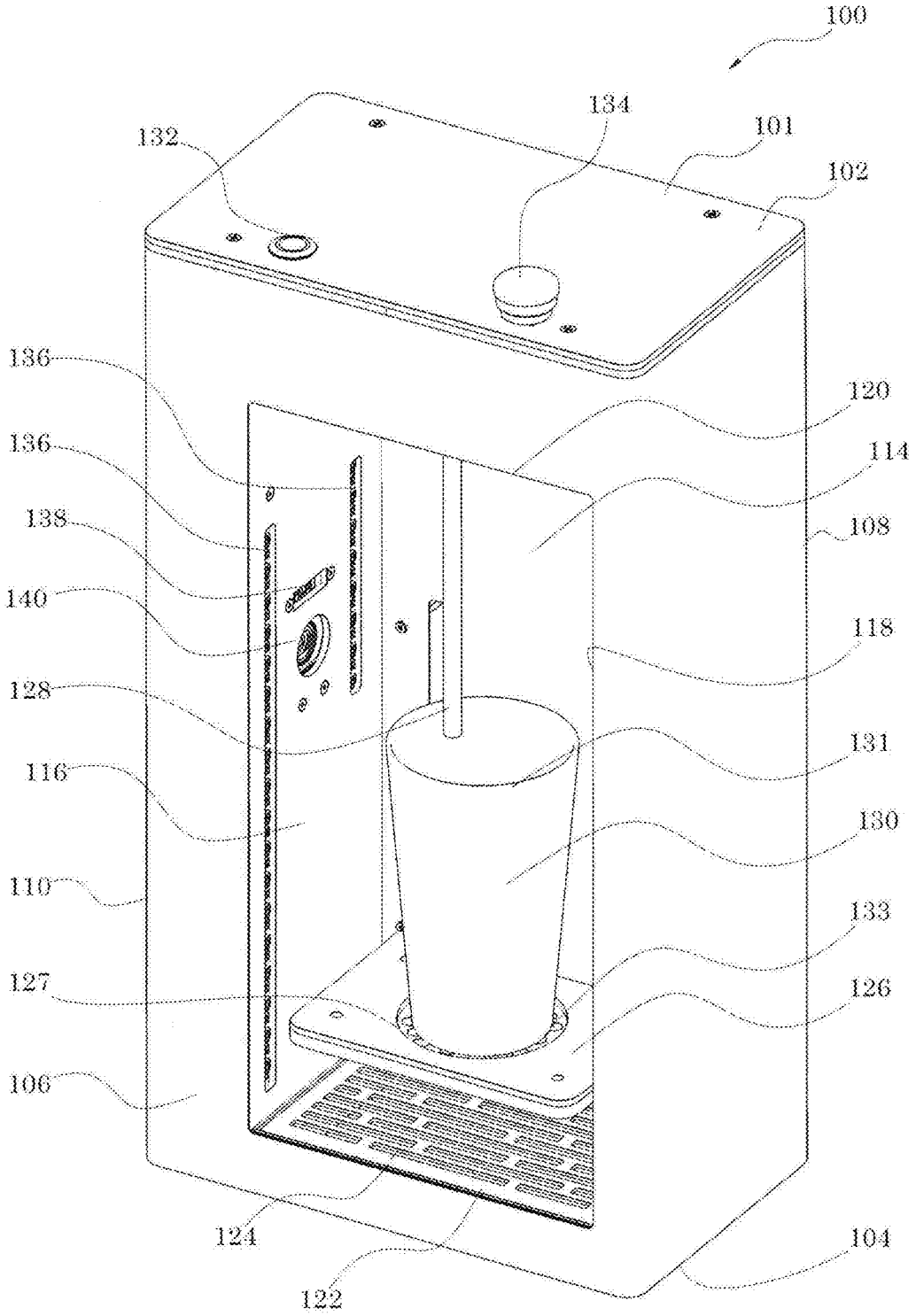
FIG. 1 shows a perspective view of an exemplary embodiment of a beer dispenser.
Figure 2:
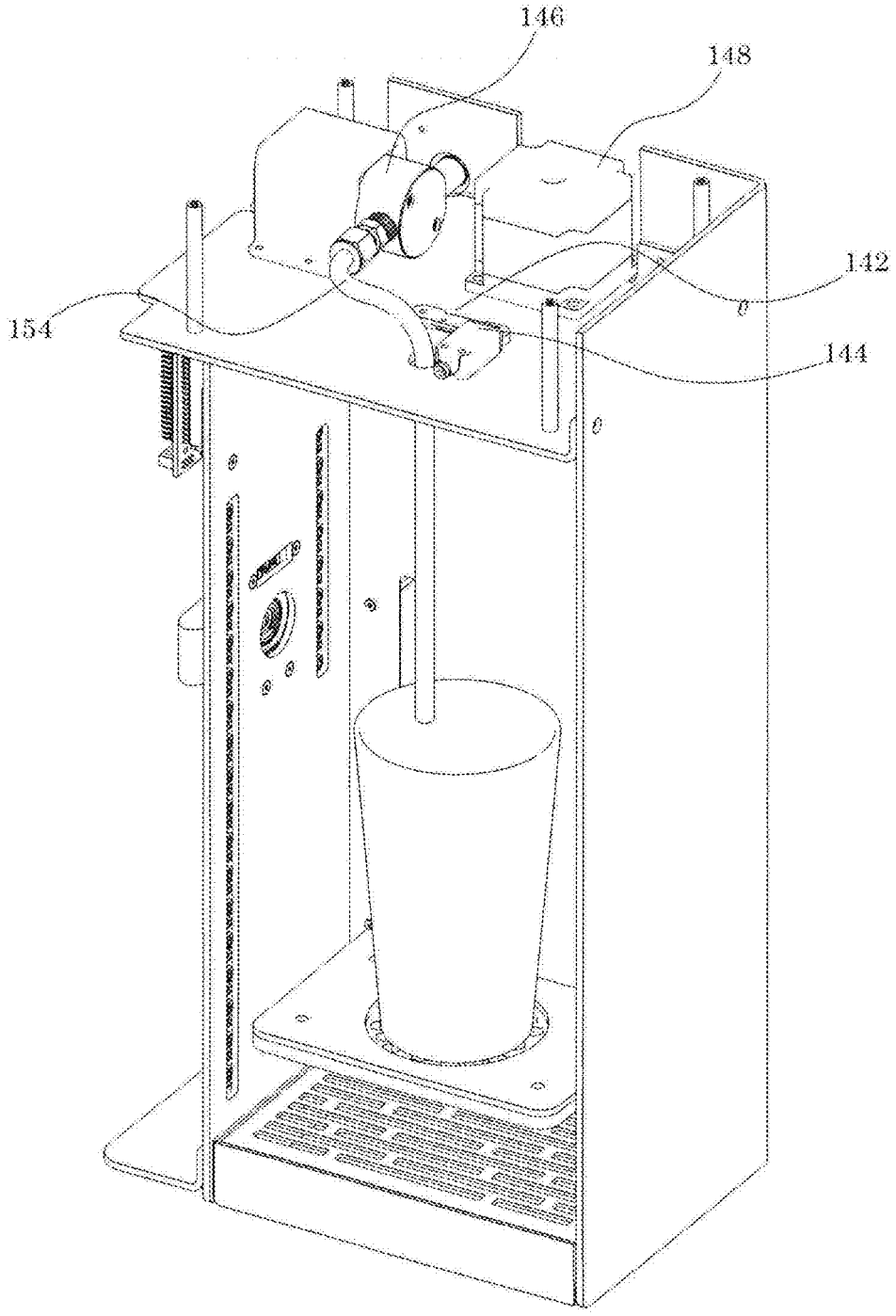
FIG. 2 shows a perspective view of the beer dispenser of FIG. 1 with a top wall and a left wall removed.
Figure 3:
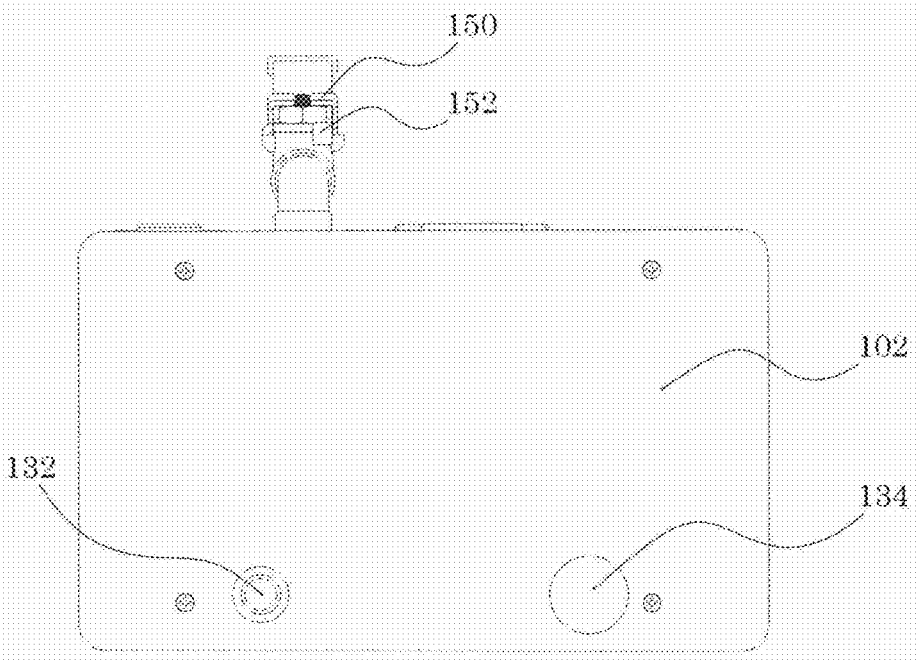
FIG. 3 shows a top view of the beer dispenser of FIG. 1.
Figure 4:
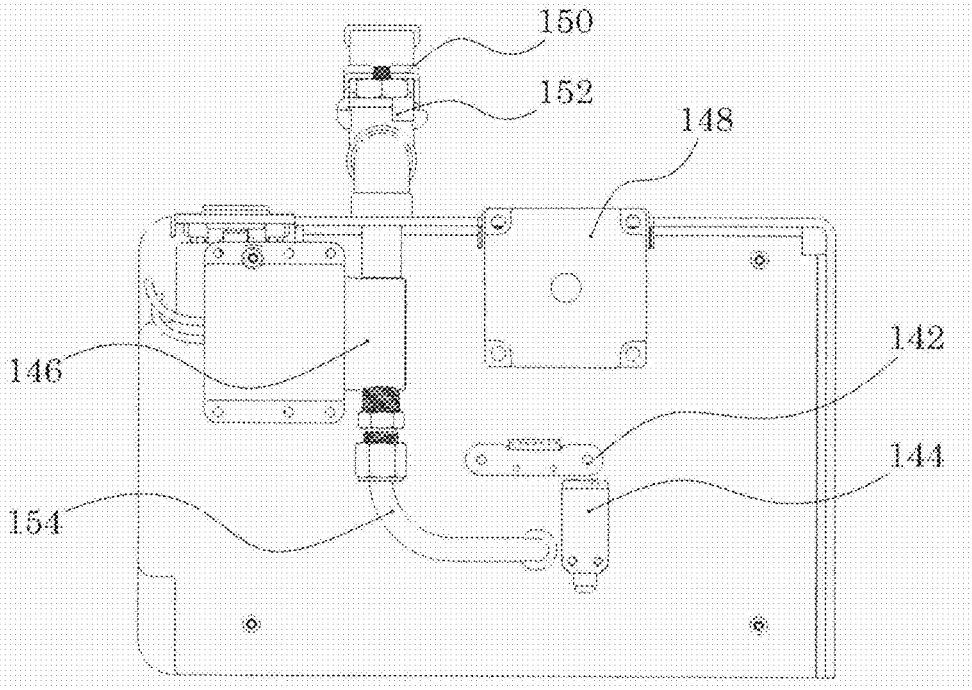
FIG. 4 shows a top view of the beer dispenser of FIG. 1 with a top wall removed.
Figure 5:
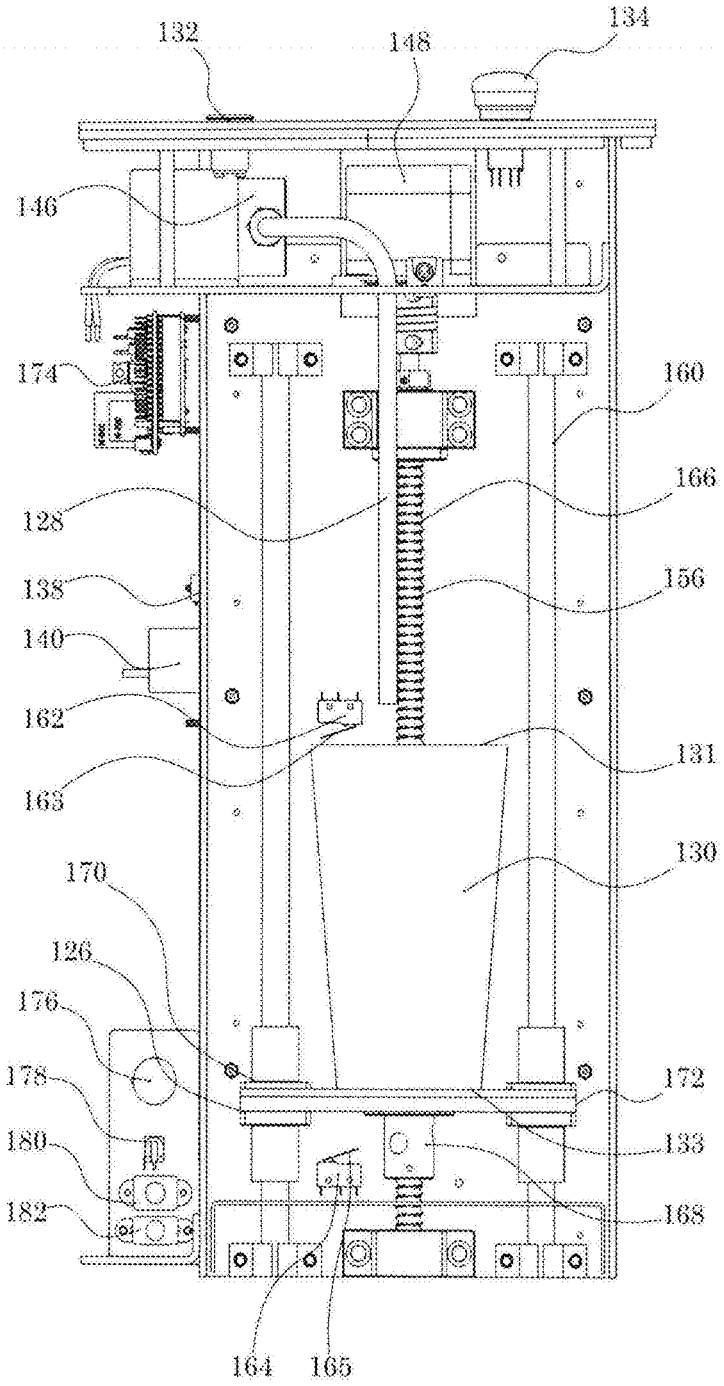
FIG. 5 shows a front sectional view of the beer dispenser of FIG. 1.
Figure 6:
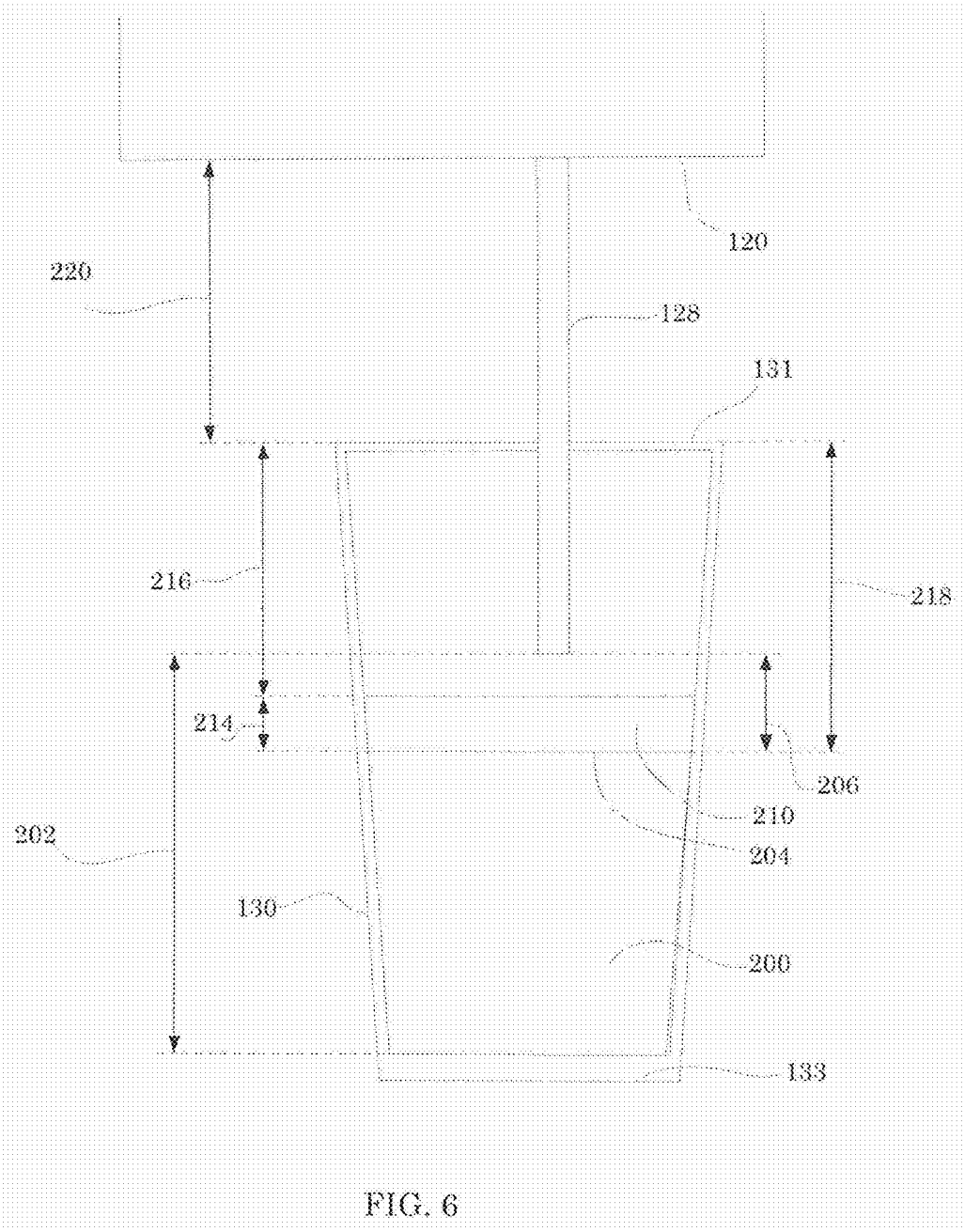
FIG. 6 shows an exemplary embodiment of a partially filled container.
Figure 7:
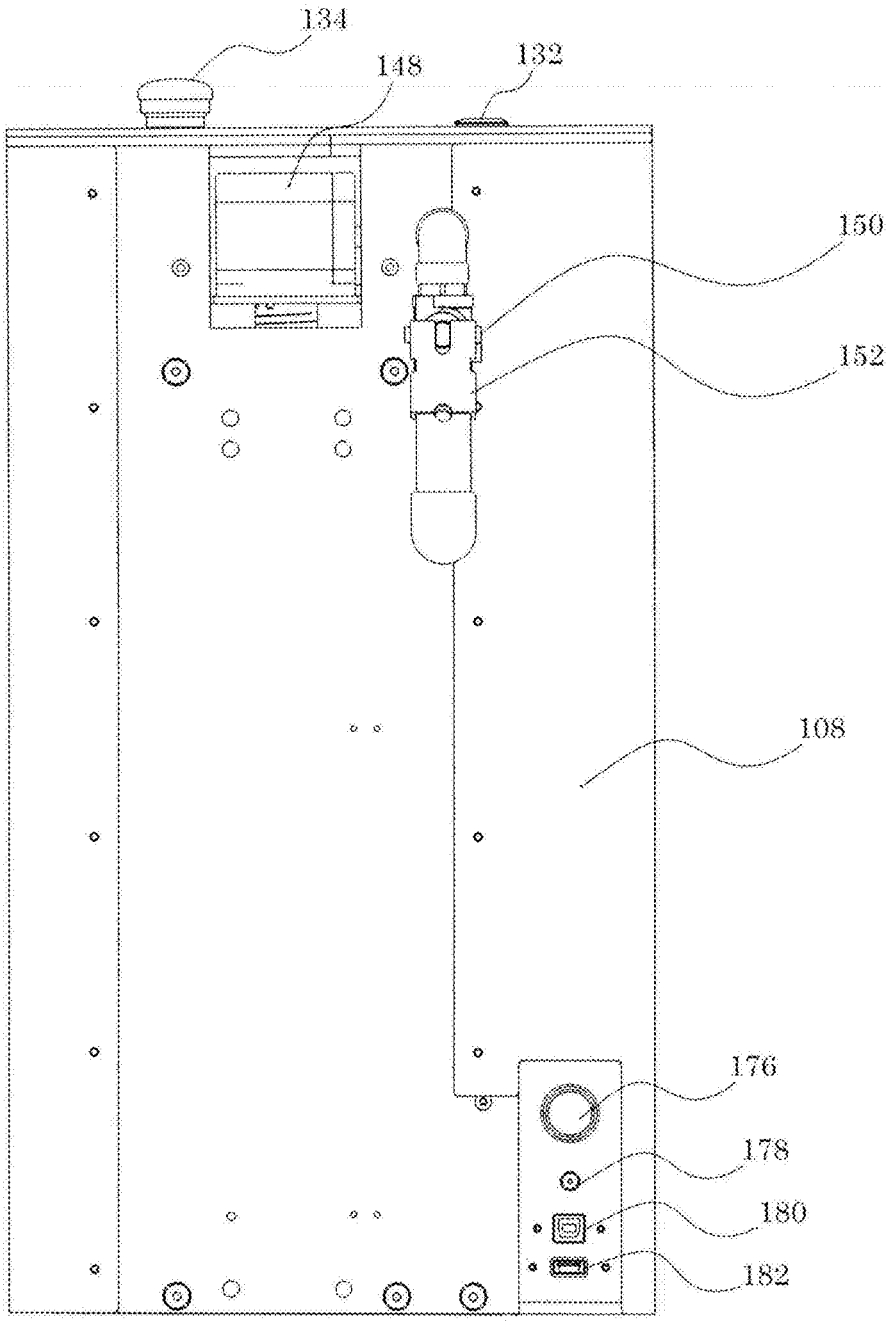
FIG. 7 shows a rear view of the beer dispenser of FIG. 1.

Various systems, devices or methods will be described below to provide an example of at least one embodiment of the claimed subject matter. No embodiment described herein limits any claimed subject matter and any claimed subject matter may cover systems, devices or methods that differ from those described herein. The claimed subject matter is not limited to systems, devices or methods having all of the features of any one process or device described below or to features common to multiple or all of the systems, devices or methods described herein. It is possible that a system, device or method described herein is not an embodiment of any claimed subject matter. Any subject matter that is disclosed in a system, device or method described herein that is not claimed in this document may be the subject matter of another protective instrument, for example, a continuing patent application, and the applicants, inventors or owners do not intend to abandon, disclaim or dedicate to the public any such subject matter by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

It should also be noted that the terms "coupled" or "coupling" as used herein can have several different meanings depending in the context in which these terms are used. For example, the terms coupled or coupling can have a mechanical, electrical or communicative connotation. For example, as used herein, the terms coupled or coupling can indicate that two or more elements or devices can be directly connected to one another or connected to one another through one or more intermediate elements or devices via an electrical element, electrical signal or a mechanical element depending on the particular context.

It should also be noted that, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that terms of degree such as "substantially", "about" and "approximately" as used herein mean a reasonable amount of deviation of the modified term such that the end result is not significantly changed. These terms of degree may also be construed as including a deviation of the modified term if this deviation would not negate the meaning of the term it modifies.

Furthermore, the recitation of numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 10%, for example.

In accordance with the teachings herein, at least one embodiment is provided for a beer dispenser. It should be appreciated that the systems and methods for dispensing beer described herein are not limited to beer; any beverage may be dispensed. For example, beverages that are self-foaming may be dispensed.

A self-foaming beverage is a beverage that, similar to beer, generates foam when poured due to the properties of the liquid. A self-foaming beverage, when poured, may result in a foam layer that covers the surface of the beverage.

The foam layer may dissipate slowly. The foam layer may dissipate relatively quickly. For example, a self-foaming beverage may be soda, pop, or any other carbonated beverage.

In some embodiments, beverages that are not self-foaming may be dispensed. For example, the beverage dispenser may be used to dispense milk, juice, whiskey, coffee, water, tea, wine, etc.

In some embodiments, liquids that are not beverages may also be dispensed using the dispensers described herein. For example, in some embodiments, the dispensers described herein may dispense any liquid and use imaging to measure the dispensed volume and/or height of the liquid. The liquid may be but is not limited to any chemical, oil, gas, or pharmaceutical liquid.

Referring now to FIGS. 1 to 8, shown therein is an example embodiment of a beer dispenser 100. The beer dispenser 100 has a housing 101. The exterior of housing 101 has a top wall 102, a bottom wall 104, a front wall 106, a back wall 108, a first sidewall 110, and a second sidewall 112. The interior of housing 101 has an inner back wall 114, a first inner side wall 116, a second inner sidewall 118, an inner top wall 120, and an inner bottom wall 122. A drip tray 124 may be placed over the inner bottom wall 122. The drip tray 124 may be used to collect beer. The drip tray 124 may be removable from the beer dispenser 100. Removing the drip tray 124 may allow for the disposal of spilled beer.

The beer dispenser 100 has a support 126. The support 126 may be used to receive a container 130. The container 130 has a rim 131 and a bottom 133. The support 126 has a plurality of perforations 127. The plurality of perforations 127 may allow beer to pass through the support 126.

The beer dispenser 100 has a beer line connector 150. The beer line connector 150 may be coupled to a beer source (not shown). The beer line connector 150 is coupled to a manual shut off 152. The manual shut off 152 may be used to stop the flow of beer through the beer line connector 150 from the beer source. The beer dispenser 100 may have a flow rate adjuster. The flow rate adjuster may control the volume of beer 200 dispensed. In some embodiments, the manual shut off 152 may be used as a flow rate adjuster.

A fluid valve 146 is coupled to the beer line connector 150. The fluid valve 146 may be any valve capable of starting and stopping the flow of beer 200 through the nozzle 128. For example, the fluid valve 146 may be a solenoid valve. The fluid valve 146 may also be a ball valve. A ball valve may be used to minimize pressure drop and turbulence across the valve. Turbulence across the valve may lead to foaming in beer. The fluid valve 146 may be used to increase turbulence. Increased turbulence may increase the foam produced in the dispensed beer 200. In some embodiments, the flow rate adjuster is the fluid valve 146. The fluid valve 146 may be electronically actuated to vary the amount the flow of the dispensed beer 200.

The fluid valve 146 may be used to start the flow of beer through the beer line connector 150. The fluid valve 146 may be used to stop the flow of beer through the beer line connector 150. A nozzle tube 154 is coupled to the fluid valve 146. The nozzle tube 154 is coupled to a nozzle 128. The nozzle tube 154 may be used to transfer beer from the fluid valve 146 to the nozzle 128. The nozzle 128 may be positionable above the container 130. The nozzle 128 may be any range of lengths suitable for dispensing beer 200 into a container 130. For example, the nozzle 128 may be approximately the length of the container 130. Being of a similar length to the container 130 may allow the nozzle 128 to be positioned near the container bottom 133. Being positioned near the container bottom 133 may allow the nozzle 128 to reduce foaming when the beer 200 is dispensed.

The beer dispenser 100 has a start button 132. The start button 132 may be used to initialize the dispensing of beer. When the start button 132 is pressed, the nozzle 128 may dispense beer 200 into the container 130. For example, the container 130 may be placed in or on the support 126. A user may press the start button 132 to begin the beer-dispensing process. The user is then free to perform other activities while the beer 200 is automatically dispensed. In some embodiments, the system may complete the dispensing of beer when the liquid level or foam level reaches the glass rim 131, or reaches a predetermined threshold distance from the glass rim 131. Once completed, the user may then remove the container 130 with the dispensed beer 200. In some embodiments, the start button 132 may be illuminated by at least one light source (not shown).

The beer dispenser 100 has an emergency stop button 134. The emergency stop button 134 may be used to cease the flow of beer. For example, while beer 200 is being dispensed by nozzle 128, if the emergency stop button 134 is pressed, the fluid valve 146 will close, and beer 200 will stop dispensing from nozzle 128. In some embodiments, once pressed, the emergency stop button 134 remains pressed. While the emergency stop button 134 remains pressed, the fluid valve 146 cannot be opened. The emergency stop button 134 may be reset by twisting the emergency stop button 134, returning it to its unpressed state.

The beer dispenser 100 may have at least one light source 136. The at least one light source 136 may be used to illuminate the beer dispenser 100. In some embodiments, the at least one light source 136 may be used to signal that the beer-dispensing process has completed. For example, when a container 130 is placed in the beer dispenser 100, the at least one light source may be a first colour. Once the beer 200 has finished dispensing, the at least one light source may change to a second colour. The second colour may indicate to the user that the beer-dispensing process has finished. In some embodiments, the at least one light source 136 may vary in brightness.

In some embodiments, the beer dispenser 100 may have an audio device. The audio device may produce a sound when the beer-dispensing process has completed. The sound may indicate to the user that the beer-dispensing process has completed.

The beer dispenser 100 has at least one imaging device. The at least one imaging device may be any device that can generate at least one image of the dispensed beer 200. For example, the at least one imaging device may be an ultrasound sensor, an infrared sensor, and/or a camera. In some embodiments, the at least one imaging device may be a range-measurement device. For example, the ultrasound sensor, sensor, and/or camera may be used to generate measurements for a range. In some embodiments, the infrared sensor may be an infrared time of flight sensor.

In some embodiments, the beer dispenser 100 has a single imaging device. In some embodiments, the beer dispenser 100 has a plurality of imaging devices. For example, the beer dispenser 100 has plurality of imaging devices. The beer dispenser 100 has a first infrared sensor 138. As exemplified, the first infrared sensor 138 may be an infrared time of flight sensor. The first infrared sensor 138 may be used to generate an infrared image of the container 130. The first infrared sensor 138 may be used to generate a range-measurement based on the container 130 to detect the rim 131 of the glass. The infrared sensor 138 may also be used to generate an infrared measurement of beer 200 dispensed by the nozzle 128. The infrared sensor 138 may also be used to generate a range-measurement based on the dispensed beer 200. The beer dispenser 100 also has a second infrared sensor 142. As exemplified, the second infrared sensor 142 may be an infrared time of flight sensor. The second infrared sensor 142 is positioned in a different location on the beer dispenser 100 than the first infrared sensor 138. The second infrared sensor 142 may generate a range-measurement based on the container 130 and/or the dispensed beer 200.

The beer dispenser 100 has a camera 140. The camera 140 may be used to generate an image of the container 130. The camera 140 may be used to generate an image of beer 200 dispensed by the nozzle 128. The beer dispenser 100 also has an ultrasound sensor 144. The ultrasound sensor 144 may be used to generate an image of the container 130. The ultrasound sensor 144 may also be used to generate an image of beer 200 dispensed by the nozzle 128. The ultrasound sensor 144 may generate a range-measurement based on the container 130. The ultrasound sensor 144 may also generate a range-measurement based on the dispensed beer 200.

In some embodiments, the various sensors may be used to detect different properties of the dispensed liquid. For example, as described above, the beer dispenser 100 may have an ultrasound sensor 144 and infrared sensors 138 and 142. The ultrasound sensor 144 may be used to detect the liquid surface 204. The downward facing infrared sensor 142 may be used to detect the foam level 214. The side facing infrared sensor 138 may be used to detect the location of the rim 131.

In some embodiments, each sensor may be used to measure a single property of the dispensed liquid. For example, the ultrasound sensor 144 may be used to detect only the liquid surface 204 and not the foam level 214, while the infrared sensor 142 may be used to detect only the foam level 214 and not the liquid surface 204.

The combination of the ultrasound sensor 144 and infrared sensor 142 tends to improve the detection of the liquid and/or foam levels. The combination of the ultrasound sensor 144 and infrared sensor 142 may be used to prevent overflow conditions when excessive foam is produced. The combination of the ultrasound sensor 144 and infrared sensor 142 may be used to more accurately provide a measurement of the upper fluid surface.

The beer dispenser 100 has at least one processor. The at least one processor may be any device or system capable of performing calculations. The at least one processor may be a micro-controller unit (MCU). The at least one processor may be a computing device. For example, the computing device may be a phone, a PC, a tablet, a laptop, a micro-controller unit, etc. For example, the beer dispenser 100 has a micro-controller unit 174. The MCU 174 may be the processor in the beer dispenser 100. The beer dispenser 100 may have a plurality of processors. For example, the beer dispenser 100 may use the MCU 174 and a computing device as processors. The at least one processor may analyze an image produced by the at least one imaging device. The at least one processor may receive range-measurements from the at least one imaging device. In some embodiments, the computing device analyzes the at least one image produced by the at least one imaging device and generates an output containing measurements. The measurements may be used by the at least one processor to control the elevation system 156. The measurements may be used by the at least one processor to control the fluid valve 146.

The MCU 174 may be used to receive the image produced by the at least one imaging device. The MCU 174 may determine a liquid upper surface 204 of the dispensed beer 200. The liquid upper surface 204 may be determined from the at least one image of the dispensed beer 200. The MCU 174 may determine a measured foam height 214 from the at least one image of the dispensed beer 200. The MCU 174 may adjust a distance 206 between the nozzle 128 and the liquid upper surface 204. The adjustment of the distance 206 between the nozzle 128 and the liquid upper surface 204 may occur while the beer is dispensed. In some embodiments, the ultrasound sensor 144 may be used to measure the range to the liquid upper surface 204. In some embodiments, the second infrared sensor 142 may be used to measure the range to the liquid upper surface 204. In some embodiments, the ultrasound sensor 144 may be used in conjunction with the second infrared sensor 142 to determine the liquid upper surface 204 and the foam level 214.

In some embodiments, the processor is coupled to the MCU 174. The processor may be the computing device. The processor may also be coupled to the at least one imaging device. The processor may receive the at least one image generated by the at least one imaging device. The processor may analyze the at least one image and output the measurement results to the MCU 174. The MCU 174 may adjust the elevation system 156 based on the measurements received from the processor. For example, the computing device may determine the liquid upper surface 204 and the measured foam height 214. The computing device may determine the adjustment necessary to adjust the distance 206 between the nozzle 128 and the liquid upper surface 204 to control the measured foam height 214. The adjustment information may be sent to the MCU 174. The MCU 174 may then control the elevation system 156 to adjust the distance 206 between the nozzle 128 and the liquid surface height 204.

In some embodiments, the at least one light source 136 may be used to illuminate the container 130. Illumination of the container 130 may improve the quality of the at least one image generated by the at least one imaging device. As described above, the at least one light source 136 may have a variable brightness. The at least one light source 136 may vary in colour. The processor may control the brightness and/or colour of the at least one light source 136 to improve the quality of the at least one image generated by the at least one imaging device. For example, the processor may receive an image from the at least one imaging device and determine that the image produced is too dark. The MCU 174 may then increase the brightness of the at least one light source 136 to improve the quality of the next image produced by the at least one imaging device.

In some embodiments, the processor may receive a desired foam height (not shown). The processor may determine a difference between the measured foam height 214 and the desired foam height. The MCU 174 may adjust the distance 206 between the nozzle 128 and the liquid upper surface 204 as the beverage is dispensed to reduce the difference between the measured foam height 214 and the desired foam height.

In some embodiments, the computing device may receive the desired foam height. The computing device may determine the difference between the measured foam height 214 and the desired foam height. The computing device may determine an adjustment necessary to reduce the difference between the measured foam height 214 and the desired foam height. The computing device may output this adjustment information to the MCU 174. The MCU 174 may use the adjustment information to control the elevation system 156 to reduce the difference between the measured foam height 214 and the desired foam height.

In some embodiments, the distance 206 may be positive, negative, or zero. When the distance 206 is positive, the nozzle 128 may be above the liquid upper surface 204. When the distance 206 is negative, the nozzle 128 may be below the liquid upper surface 204. When the distance 206 is negative, the nozzle 128 may be at the liquid upper surface 204.

For example, if the measured foam height is 1 cm and the desired foam height is 0.2 cm, the MCU 174 may use an elevation system 156 to raise the support 126. By raising the support 126, the distance 206 between the nozzle 128 and the liquid upper surface 204 may be reduced. By reducing the distance 206, the beer 200 dispensed from the nozzle 128 may fall a shorter distance to reach the liquid upper surface 204. Maintaining a small distance between the nozzle 128 and the liquid upper surface 204 may result in lower kinetic energy, lower turbulence, and lower air entrainment. Reducing these factors may reduce the amount of foam 210 produced as the beer 200 is dispensed. Therefore, when the beer 200 falls a shorter distance, less foam 210 may be generated as the beer 200 contacts the liquid upper surface 204. Similarly, if the desired foam height is 1 cm and the measured foam height 214 is 0.2 cm, the measured foam height 214 may be increased by lowering the support 126. Lowering the support 126 increases the distance 206 between the nozzle 128 and the liquid upper surface 204. Increasing the distance 206 may increase the kinetic energy, turbulence, and air entrainment. Increasing these factors may increase the measured foam height 214.

In some embodiments, the desired foam height may be zero. When the desired foam height is zero, the distance 206 may be negative while the beer 200 is dispensed. Thus, the nozzle 128 may be below the liquid upper surface 204 the entire time the beer 200 is dispensed. In some embodiments, when the desired foam height is zero, the distance 206 is kept a very small positive number. By keeping the distance 206 a small positive number, the nozzle 128 does not contact the beer 200, while also reducing the foam 210. Thus, keeping the distance 206 a small positive number may reduce foam 210 while keeping the nozzle 128 clean.

In some embodiments, the processor may measure a beverage characteristic and/or the foam height. For example, the processor may determine a measured beverage characteristic and a liquid upper surface from the at least one image of the dispensed beverage. The MCU 174 may adjust a distance between the nozzle and the liquid upper surface as the beverage is dispensed to control the measured beverage characteristic.

In some embodiments, the processor may determine a difference between a measured beverage characteristic and a desired beverage characteristic. The MCU 174 may then adjust the distance between the nozzle and the liquid upper surface as the beverage is dispensed to reduce the difference between the measured beverage characteristic and the desired beverage characteristic. For example, beverage characteristics may include, but are not limited, to the height of the beverage and/or the height of the foam.

In some embodiments, the processor may determine a liquid upper surface from the at least one image generated by the at least one imaging device. The processor may adjust a flow rate from the nozzle to control the liquid upper surface. For example, the processor may use the at least one image generated by the at least one imaging device to determine how much beer 200 has been dispensed. The processor may adjust the flow rate of the nozzle 128 depending on how much beer 200 has already been dispensed. When the liquid upper surface 204 reaches a threshold value, based on either volume or height of dispensed beer 200, the processor may slow or cease the flow of beer 200. The process of determining the liquid upper surface level from the image may be used on any beverage or liquid. For example, there may be a beverage dispenser that dispenses wine. An image may be generated using the at least one imaging device. The processor may determine the liquid upper surface of the wine from the at least one image. The flow rate of the dispensed wine may be controlled to ensure that the proper threshold is reached, either volume or height of the dispensed wine.

In some embodiments, the beer dispenser 100 may have a memory. The memory may be coupled to the processor. For example, the memory may be coupled to the MCU 174 and/or the computing device. The memory may store the desired foam height. The memory may store the desired foam height for a plurality of beers. For example, a first beer may have a first desired foam height. A second beer may have a second desired foam height. The first and second desired foam heights may be the same. The first and second foam heights may be different.

In some embodiments, the type of beer dispensed by the beer dispenser 100 may be selected. For example, a first beer may be selected on the computing device. The MCU 174 may receive the first beer selection. The first beer may have a desired foam height. The desired foam height of the first beer may be zero. During operation, the MCU 174 may attempt to reduce the foam height to zero by controlling the elevation system 156. A second beer selected on the computing device may have a desired foam height of 1 cm. During operation, the MCU 174 may attempt to achieve a foam height of 1 cm by controlling the elevation system 156. As described above, a memory may be used to store the desired foam heights for more than one type of beer.

The elevation system 156 may be used to adjust the distance 206 between the nozzle 128 and the liquid upper surface 204. The elevation system 156 includes a drive motor 148. The drive motor 148 may be any driving device capable of adjusting the elevation system 156. For example, the drive motor 148 may be a stepper motor.

In some embodiments, the drive motor 148 is coupled to a lead screw 166. The lead screw 166 is coupled to the support 126. The lead screw 166 passes through a threaded aperture 168 in the support 126. The drive motor 148 actuates the lead screw 166. Actuating the lead screw 166 causes the lead screw 166 to rotate. As the lead screw 166 rotates through the threaded aperture 168, the support 126 moves along the lead screw 166. Rotation of the lead screw 166 in a first direction causes the support 126 to move upwards. Rotation of the lead screw 166 in a second direction causes the support 126 to move downwards. As mentioned previously, the support 126 receives the container 130. As the support 126 moves up and down the lead screw 166, the container 130 moves up and down. The position of the liquid upper surface 204 may be changed by the movement of the support 126. Thus, by moving the support 126, the distance 206 between the nozzle 128 and the liquid upper surface 204 may be changed.

The support 126 is coupled to a first riser 170. The support 126 is coupled to a second riser 172. The first riser 170 is slidingly coupled to a first riser slot 158. The second riser 172 is slidingly coupled to a second riser slot 160. The first and second risers 170 and 172 provide additional stability to the support 126. Actuation of the lead screw 166 causes the support 126 to move up and down, which in turn moves the first and second risers 170 and 172 along the first and second riser slots 158 and 160.

The elevation system 156 has a first end stop 162. The elevation system has a second end stop 164. The first end stop 162 provides an upper limit for the motion of the support 126. The second end stop 164 provides a lower limit for the motion of the support 126. The first and second end stops 162 and 164 may be mechanical switches with sensors. For example, the first end stop 162 has a first end stop sensor 163. The second end stop 164 has a second end stop sensor 165. When the support 126 reaches the first end stop sensor 163, a signal is sent to the MCU 174. The MCU 174 then stops the upward motion of the support 126. When the support 126 reaches the second end stop sensor 165, a signal is sent to the MCU 174. The MCU 174 then stops the downward motion of the support 126.

The elevation system 156 may be any system capable of adjusting the distance 206 between the nozzle 128 and the liquid upper surface 204. In some embodiments, the elevation system 156 may be coupled to the nozzle 128. Actuating the elevation system 156 may change the position of the nozzle 128. Thus, the elevation system 156 may adjust the distance 206 between the nozzle 128 and the liquid upper surface 204 by changing the position of the nozzle 128. For example, in some embodiments, the beer dispenser 100 may lack a support 126. In such embodiments, the beer dispenser 100 may be placed on a surface. For example, the surface may be a countertop. The container 130 may be placed under the nozzle 128 on the surface. The elevation system 156 may control the position of the nozzle 128 to adjust the distance 206 between the nozzle 128 and the liquid upper surface 204. The nozzle 128 may start near the container bottom 133. As the beer 200 is dispensed, the nozzle 128 may be raised by the elevation system 156 to ensure the proper distance 206 is maintained.

In some embodiments, the elevation system 156 may be coupled to both the nozzle 128 and the support 126. The distance 206 between the nozzle 128 and the liquid upper surface 204 may be changed by altering the position of at least one of the nozzle 128 and the support 126. The emergency stop button 134 may be used to cease the motion of the nozzle 128. The emergency stop button 134 may be used to cease the motion of the support 126. The emergency stop button 134 may be used to cease the motion of both the nozzle 128 and the support 126.

In other words, in some embodiments the position of the nozzle 128 is altered to adjust the distance 206 between the nozzle 128 and the liquid upper surface 204. In other embodiments, the position of the support 126 is altered to adjust the distance 206 between the nozzle 128 and the liquid upper surface 204. In some embodiments, the position of the support 126 and/or the nozzle 128 may be altered to adjust the distance 206 between the nozzle 128 and the liquid upper surface 204.

In some embodiments, the fluid valve 146 may be used to adjust the measured foam height 214. For example, as described above, the fluid valve 146 may be electronically actuated to control the flow of dispensed beer 200. The processor may be used to adjust the flow of beer 200 through the fluid valve 146. Adjusting the flow of beer 200 may change the measured foam height 214. For example, the MCU 174 may be used to increase the flow of beer 200 through the fluid valve 146. Increasing the flow of beer 200 may increase the speed at which beer 200 is dispensed into the container 130. Increasing the speed of dispensing beer 200 may increase the amount of foam 210 generated. Increasing the amount of foam 210 may increase the measured foam height 214.

The beer dispenser 100 has a power button 176. The beer dispenser 100 has a power source input. The power source may be located within the beer dispenser 100, such as a battery, or may be external to the beer dispenser 100. For example, the beer dispenser 100 has a DC input connector 178. The beer dispenser 100 is connected to a power source (not shown) through the DC input connector 178. When the beer dispenser 100 is connected to a power source and is in an off state, pressing the power button 176 will turn the beer dispenser 100 on. When the beer dispenser 100 is connected to a power source and is in an on state, pressing the power button 176 will turn the beer dispenser 100 off. In some embodiments, the beer dispenser 100 may have an automatic reset function. For example, if the beer dispenser 100 loses power, the fluid valve 146 may automatically return to the closed position. Automatically closing the fluid valve 146 may prevent excess beer 200 from being dispensed when the beer dispenser 100 loses power.

The beer dispenser 100 has a micro-controller unit USB connector 180 (MCU USB connector). Connecting the beer dispenser 100 to a computing device (not shown) allows for data transfer between the computing device and the beer dispenser 100 through the MCU USB connector 180.

The beer dispenser 100 has camera USB connector 182. Connecting the beer dispenser 100 to a computing device (not shown) allows for data transfer between the computing device and the beer dispenser 100 through the camera USB connector 182.

Any data transfer means may be used to transfer data between a computing device and the beer dispenser 100. For example, a wireless connector may be provided on the beer dispenser 100 to transfer data wirelessly to and from a computing device. In some embodiments, the processor is wirelessly coupled to the beer dispenser 100. For example, the MCU 174 may have a wireless receiver to wirelessly receive instructions from the computing device (processor). The at least one imaging device may have a wireless transceiver to wirelessly send images to the processor and receive instructions from the processor. The computing device may wirelessly receive an image from the at least one imaging device, determine measurements needed to control the elevation system 156, and wirelessly transmit these measurements to the MCU 174. The MCU 174 may then adjust the elevation system 156 and/or the fluid valve 146 as desired.

Figure 10:
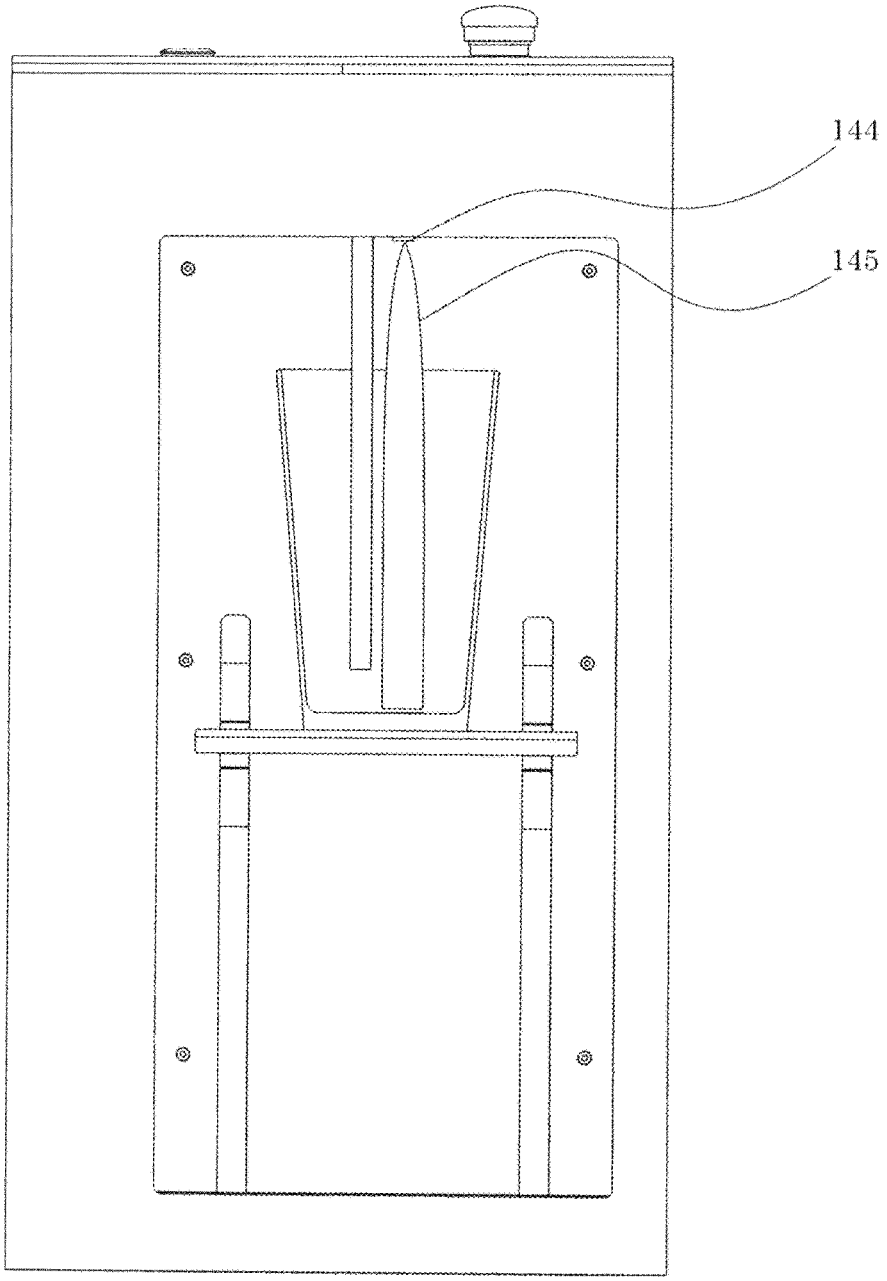

In some embodiments, the beer dispenser 100 may have a bottom sensor. The bottom sensor may determine an initial position of the nozzle 128 relative to the container bottom 133. As shown in FIG. 10, the bottom sensor is the ultrasound sensor 144. The first and/or second infrared sensors 138 and 142 may also be used as the bottom sensor. The camera 140 may also be used as the bottom sensor. When the support 126 receives a container 130, the position of the container bottom 133 is sent to the processor. After receiving the container 130, the elevation system 156 may raise the container 130 towards its starting position by raising the support 126. During motion, the processor may compare the position of the nozzle 128 to the position of the container bottom 133 by calculating a distance 202 between the nozzle 128 and the container bottom 133. Once the distance 202 between the nozzle 128 and the container bottom 133 reaches a starting threshold value, the MCU 174 stops the upward motion of the container 130. By checking the distance 202 between the nozzle 128 and the container bottom 133, the nozzle 128 may be placed in a desired starting position to reduce foam. Further, checking the distance 202 ensures that the nozzle 128 does not contact the container bottom 133, thereby preventing damage to both the nozzle 128 and the container 130.

For example, the starting threshold value may be 1 cm. When the nozzle 128 reaches the distance 202 of 1 cm away from the container bottom 133, the elevation system 156 may cease raising the container 130.

In some embodiments, the beer dispenser 100 may have a rim sensor. The rim sensor may determine a position of the container rim 131. The rim sensor may be the first infrared sensor 138 and/or the second infrared sensor 142. As exemplified in FIGS. 1-12, the first infrared sensor 138 may be used as the rim sensor. The camera 140 may also be used as the rim sensor. When the support 126 receives the container 130, an image of the container rim 131 may be sent to the processor. The processor may determine the position of the container rim 131. After receiving the container 130, the elevation system 156 may raise the container 130 towards its starting position. As beer 200 is dispensed, the processor may calculate a distance 218 between the container rim 131 and the liquid upper surface 204. Once the distance 218 between the position of the container rim 131 and the liquid upper surface 204 reaches a liquid threshold value, the MCU 174 may stop motion of the container 130. The MCU 174 may also send a signal to close the fluid valve 146 and cease dispensing beer 200. The elevation system 156 may then lower the container 130. Once lowered, the container 130 may be removed from the beer dispenser 100.

For example, the liquid threshold value may be 2 cm. When the distance 218 reaches 2 cm, the fluid valve 146 may be closed, and the container 130 may be lowered. The container 130 may then be removed from the beer dispenser 100.

In some embodiments, the processor calculates a distance 216 between the container rim 131 and a foam top surface 212. The distance 216 may be calculated using the at least one imaging device. The distance 216 may be calculated using the second infrared sensor 142. Once the distance 216 between the position of the container rim 131 and the top surface 212 of foam 210 reaches a foam threshold value, the MCU 174 may stop motion of the container 130. The MCU 174 may also send a signal to close the fluid valve 146 and cease dispensing beer. The elevation system 156 may then lower the container 130. In some embodiments, the processor may calculate both distances 216 and 218. The MCU 174 may then send a signal to close the fluid valve 146 and cease dispensing beer when either distance 216 or 218 reach a threshold. The elevation system 156 may then lower the container 130. By tracking the position of the container rim 131, the measured foam height 214 and/or liquid upper surface 204, the beer dispenser 100 may prevent spillage of beer and minimize waste.

In some embodiments, there may be a delay before the container 130 is lowered. For example, when the distance 216 reaches the foam threshold value, the MCU 174 may pause dispensing beer 200. The processor may check the distance 218 between the container rim 131 and the liquid upper surface 204. If the liquid threshold has not yet been reached, the MCU 174 may wait a period for the foam 210 to reduce. Once the foam 210 reduces below the foam threshold value, the MCU 174 may begin to dispense beer 200. This process may be repeated until the liquid threshold value is reached. Once the liquid threshold value is reached, the container 130 may be lowered.

In some embodiments, as the container 130 is raised to its initial position, the MCU 174 and/or the processor calculates a distance 220 between the container rim 131 and the inner top wall 120. When the distance 220 reaches a threshold value, the MCU 174 stops the motion of the container 130. By checking the distance 216 between the container rim 131 and the inner top wall 120, the MCU 174 ensures that the container 130 will not contact the inner top wall 120.

In some embodiments, the beer dispenser 100 may have a flow measurement device. The flow measurement device may measure the volume of the dispensed beer 200. In some embodiments, the flow measurement device is a separate device coupled to the beer dispenser 100. In some embodiments, the flow measurement device may be the at least one imaging device. For example, the volume of the dispensed beer may be measured by the at least one imaging device. The at least one image generated by the at least one imaging device may be analyzed to calculate the volume of the dispensed beer. The at least one image may depict the liquid upper surface 204 and the shape and size of the container 130. The at least one processor may take measurements of the liquid upper surface 204 and the shape and size of the container 130. These measurements may be used by the processor (MCU 174 and/or the computing device) to calculate the volume of the dispensed beer 200.

By measuring the volume of the dispensed beer 200, a user may more accurately be able to determine the amount of beer that has been used. If the initial beer source size is known, a user may be able to determine when a new beer source will be needed to replace the previous beer source. Being able to predict when a new beer source is needed may reduce the time taken to exchange beer sources because a new beer source may be attained prior to the old beer source being emptied. Further, measuring the volume of dispensed beer 200 may allow a user to more accurately track inventory and costs. By more accurately tracking inventory, a user may be able to discourage the theft or under-the-table selling of beer. Tracking and optimizing the measured foam height 214 and/or the liquid surface height 204 may reduce overpours. For example, a server may intend to pour 12 oz. of beer, but may accidentally pour 14 oz. of beer. Over time, the excess poured beer may significantly add to costs.

In some embodiments, the beer dispenser 100 may include a refrigeration system. The refrigeration system may be used to adjust the temperature of the beer dispenser 100. A thermal sensor may be used to determine the temperature of the dispensed beer 200. The processor may be used to control the refrigeration system to adjust the temperature of the dispensed beer 200. In some embodiments, the refrigeration system may be separate from the beer dispenser 100. For example, the refrigeration system may surround, or be a part of, the beer source. The processor of the beer dispenser 100 may be used to control the refrigeration system to adjust the temperature of the dispensed beer 200.

In some embodiments, the beer dispenser 100 may have a second nozzle. The second nozzle may dispense beer into a second container. The beer dispensed by the second nozzle may be the same as the beer dispensed by the nozzle 128. The beer dispensed by the second nozzle may be a different beer than the beer dispensed by the nozzle 128. For example, the nozzle 128 may dispense a first beer and the second nozzle may dispense a second beer. A user may be able to dispense multiple beers at the same time. Being able to prepare multiple beers at the same time may help to increase serving efficiency.

In some embodiments, a plurality of beer sources may be connected to the beer dispenser 100. The beer dispenser 100 may have a plurality of nozzles for dispensing the plurality of beer sources. Each nozzle may correspond to a separate beer source. Thus, a user may be able to dispense more than one beer at the same time.

In some embodiments, the beer dispenser 100 may have a user input. The user input may be a part of the at least one processor. The user input may be a display on the beer dispenser 100. The user input may be the computing device. The user input may allow a user to select the desired beer source to dispense beer 200.

In some embodiments, the beer dispenser 100 may be used to pour a flight of beer. For example, there may be four nozzles 128 for dispensing four different beers. A user may select the desired beer source on the display for each of the four beers to be poured. The four nozzles 128 may then be used to simultaneously pour a flight of four beers.

Figure 8:
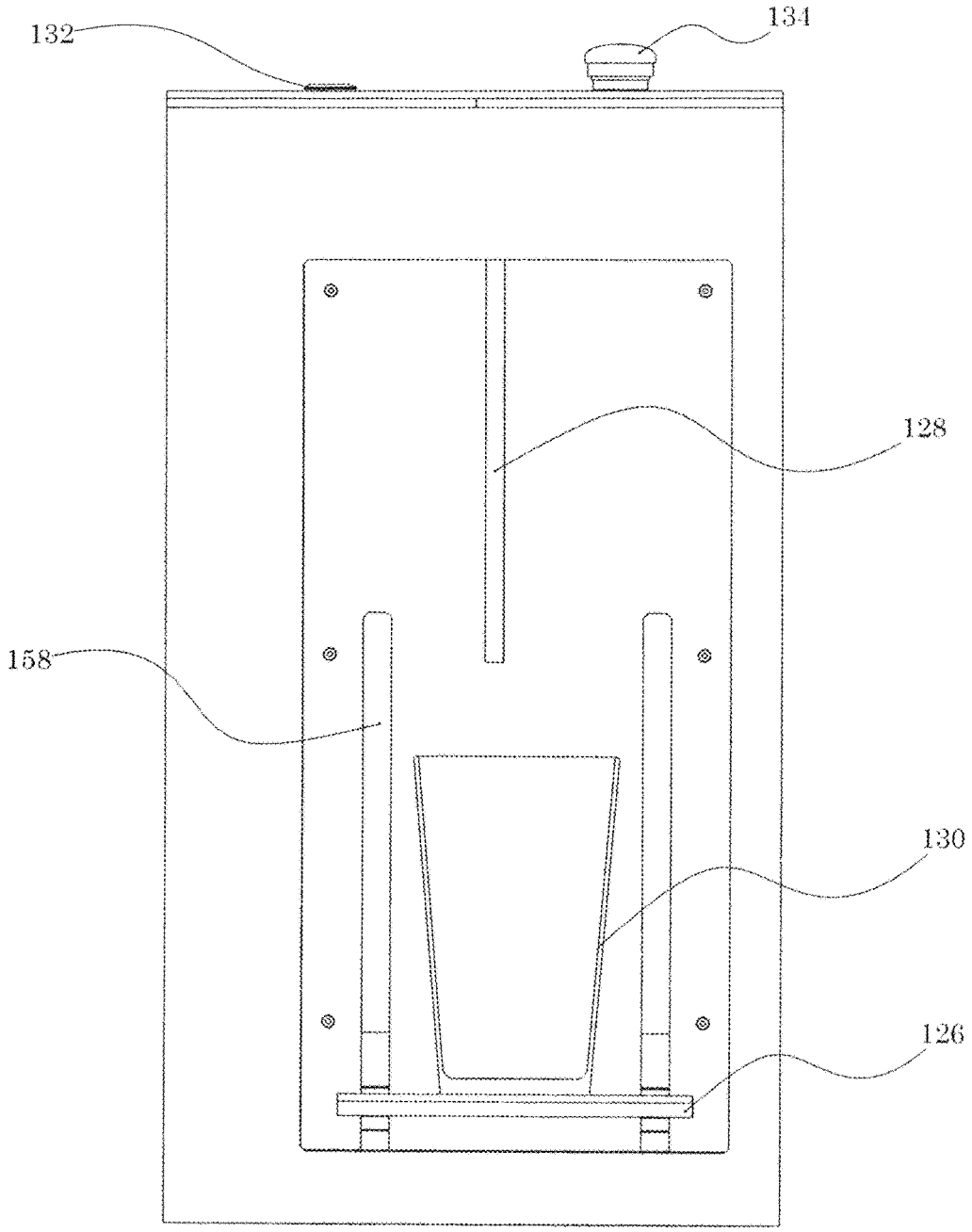
FIGS. 8-12 show the beer dispenser of FIG. 1 in various stages of operation.

Referring now to FIGS. 8-12, shown therein is the beer dispenser 100 at various stages of the beer dispensing process. FIG. 8 shows the beer dispenser 100 after receiving an empty container 130.

Figure 9:
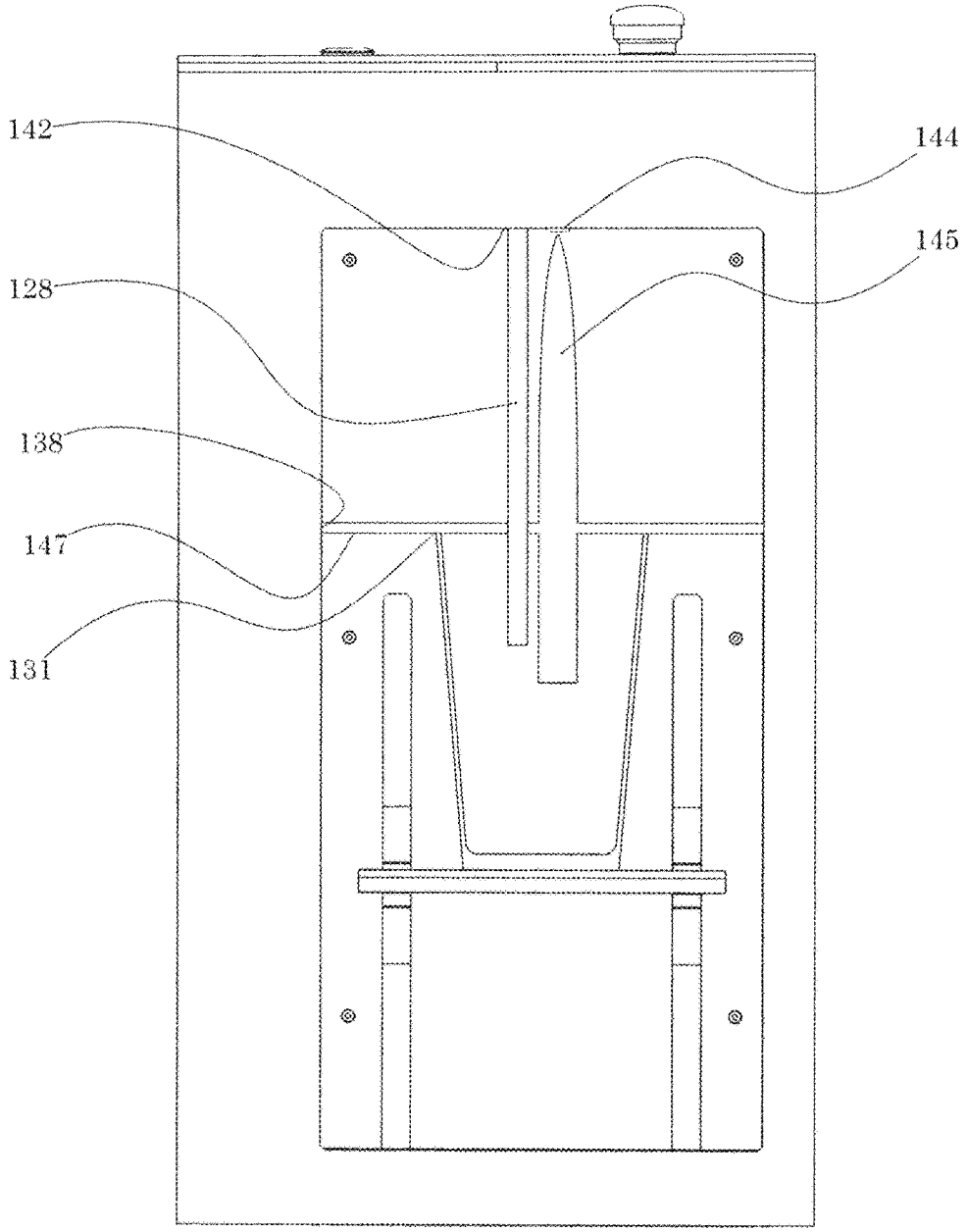

FIG. 9 shows the beer dispenser 100 as the container is elevated to the starting position. To reach the starting position, the elevation system 156 may raise the support 126. As the container 130 is raised, the bottom sensor and rim sensor may determine the position of the container bottom 133 and the container rim 131. The infrared sensor 138 with sensing field 147 may determine the position of the container rim 131.

FIG. 10 shows the beer dispenser 100 in its starting position, before beer has been dispensed. For example, as shown in FIG. 10, the ultrasound sensor 144 emits an ultrasound-sensing field 145. The ultrasound-sensing field 145 generates an image. The processor receives the image from the ultrasound sensor 144. The processor may determine the position of the container bottom 133. The processor may determine the distance 202 between the nozzle 128 and the container bottom 133. As described above, when the distance 202 between the nozzle 128 and the container bottom 133 reaches a starting threshold value, the elevation system 156 stops its motion upwards. After the starting threshold value is reached, the elevation system 156 may begin to lower the support 126 and the nozzle 128 may begin dispensing beer 200.

Figure 11:
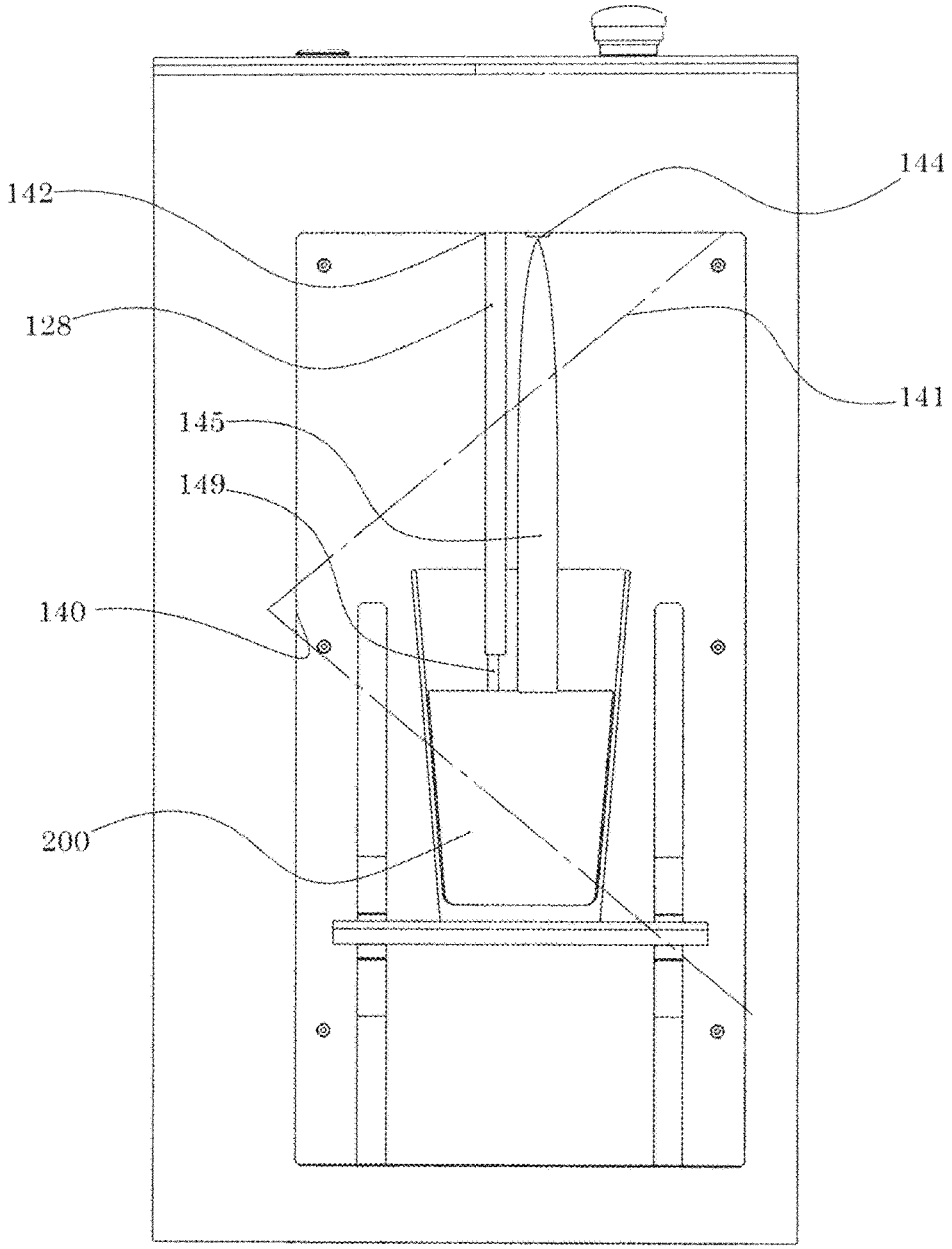

FIG. 11 shows a container 130 that has been partially filled with dispensed beer 200. As the container 130 is lowered, the at least one imaging device may generate at least one image of the dispensed beer 200 and the container 130. For example, as shown in FIG. 11, the camera 140 has a camera field of view 141. The camera 140 generates an image. The processor receives the image. The processor determines the liquid upper surface 204 of the dispensed beer 200. The processor determines and measures the foam height 214 of the foam 210. The processor also determines the distance 206 between the nozzle 128 and the liquid upper surface 204. If the foam height 214 is too high, the MCU 174 may control the elevation system 156 to reduce the distance 206 between the nozzle 128 and the liquid upper surface 204. If the measured foam height 214 is too low, the MCU 174 may control the elevation system 156 to increase the distance 206 between the nozzle 128 and the liquid upper surface 204. As the beer 200 is dispensed, the at least one imaging device may take a plurality of images. Each time the processor (e.g. MCU 174 and/or the computing device) receives an image from the at least one imaging device, the measured foam height 214 may be reviewed to determine if a change in the distance 206 is needed. This process is repeated until the desired volume of dispensed beer 200 is reached, the foam top surface 212 reaches a threshold distance from the container rim 131, or the liquid upper surface 204 reaches a threshold distance from the container rim 131. The elevation system 156 may then lower the container 130 until the second end stop 164 is reached. As previously described, a flow measurement device may measure the volume of dispensed beer 200. Once a threshold volume of dispensed beer 200 is reached, the fluid valve 146 may be closed and the dispensing of beer 200 may cease.

Figure 12:
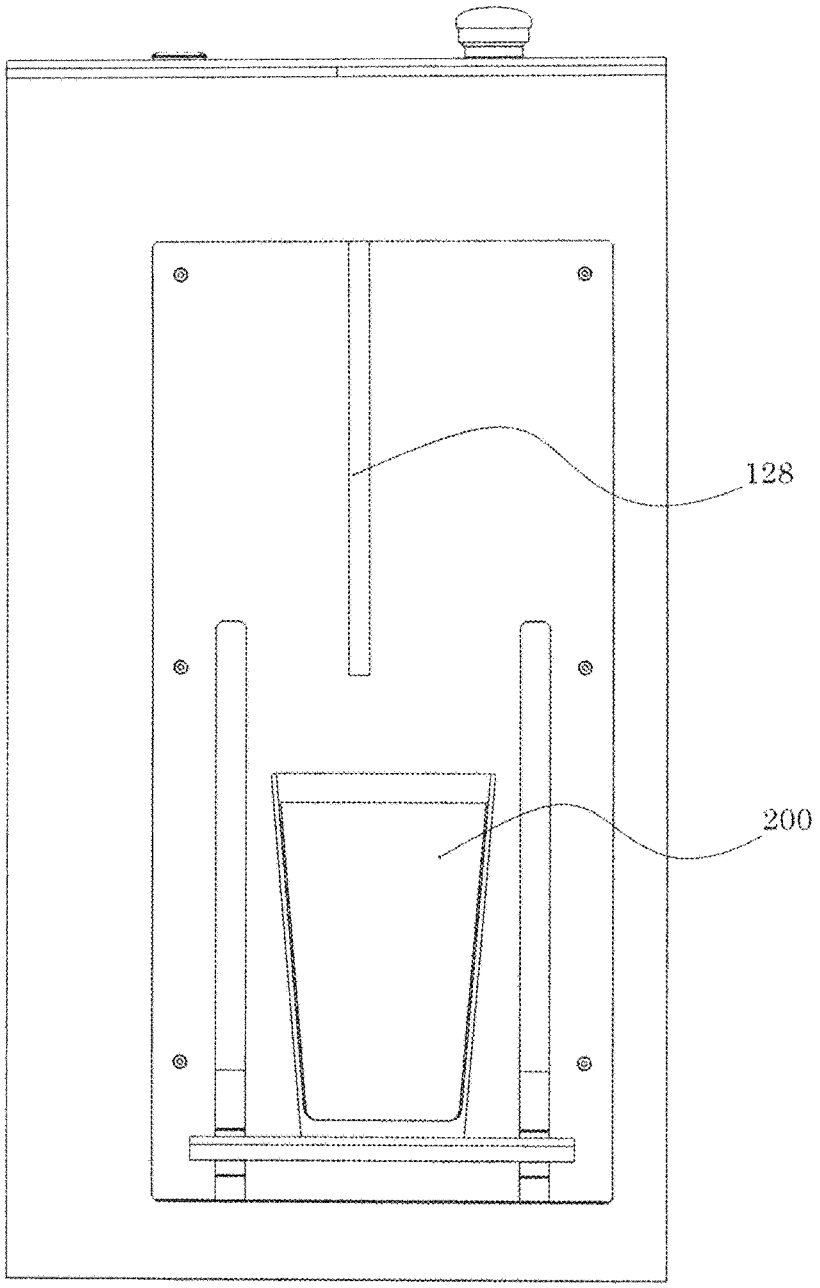

FIG. 12 shows the container 130 after beer 200 has finished dispensing from nozzle 128. The support 126 is positioned at the second end stop 164. The container 130 may then be removed from the beer dispenser 100.

Referring now to FIGS. 13-19, shown therein are example images generated by the at least one imaging device of the beer dispenser 100. Specifically, the images shown in FIGS. 13-19 were generated by the camera 140.

Figure 13A:
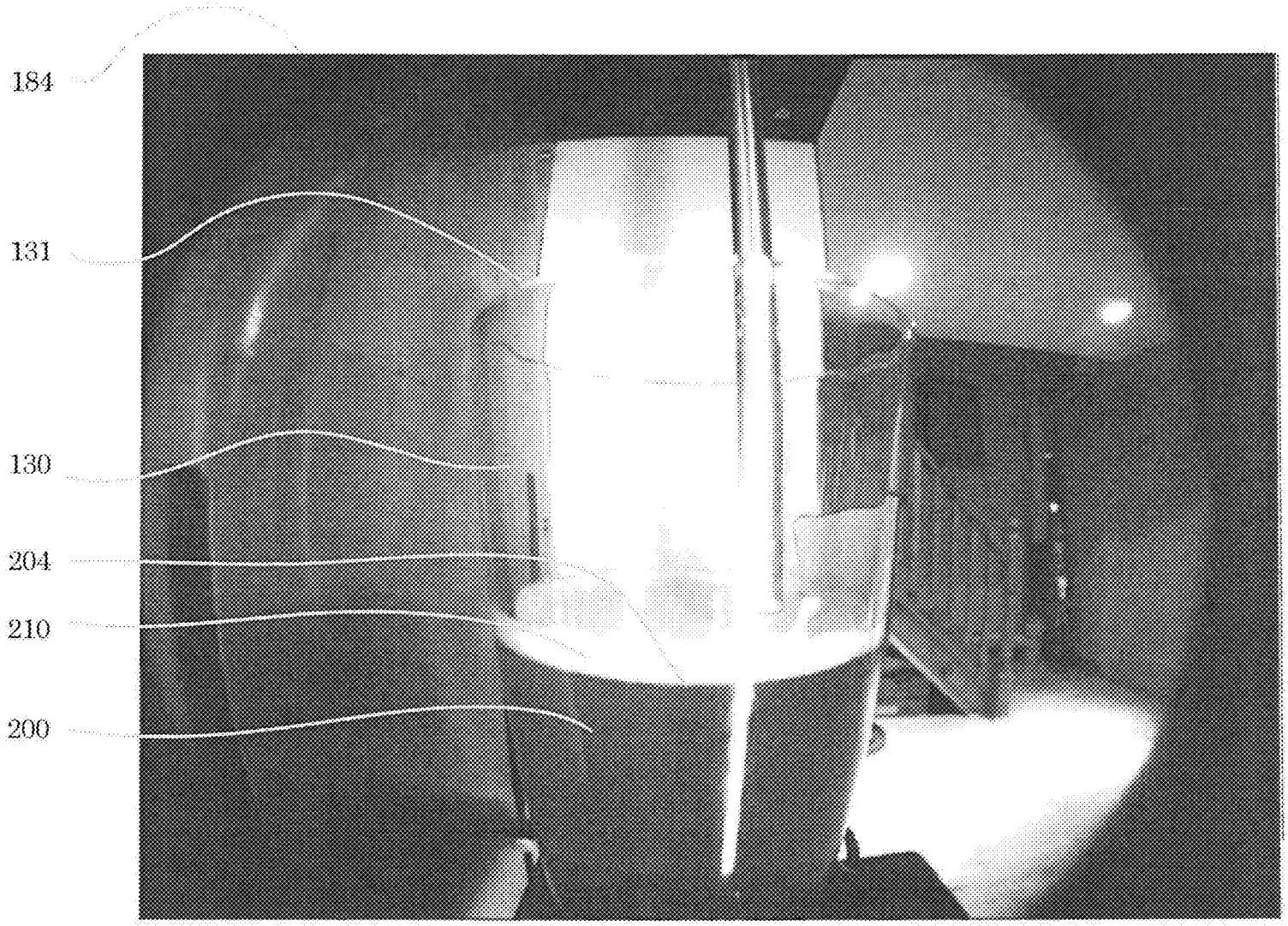
FIGS. 13A-15 show exemplary images of the beer dispenser of FIG. 1.

FIG. 13A shows a base image 184 taken by the camera 140.

Figure 13B:
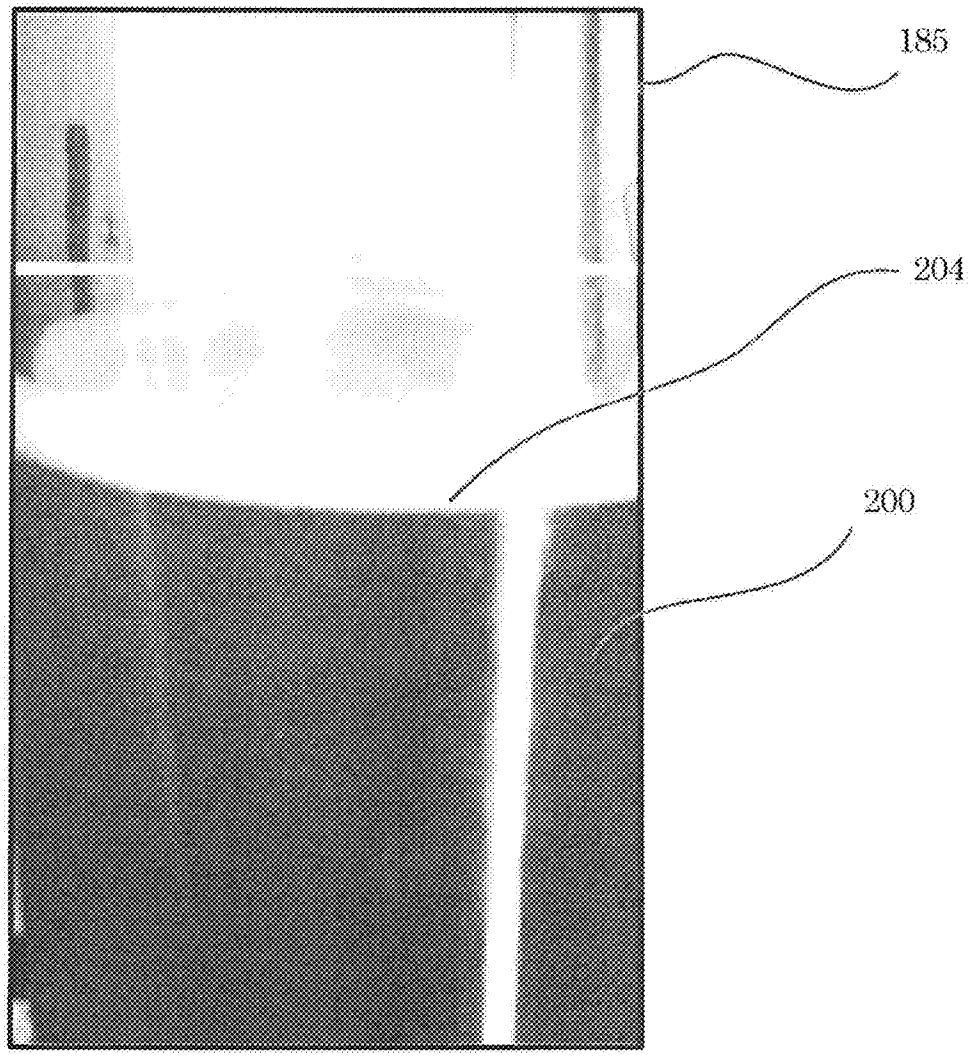

FIG. 13B shows an undistorted image 185. Base image 184 has been undistorted and cropped to produce distortion corrected image 185.

Figure 14A:
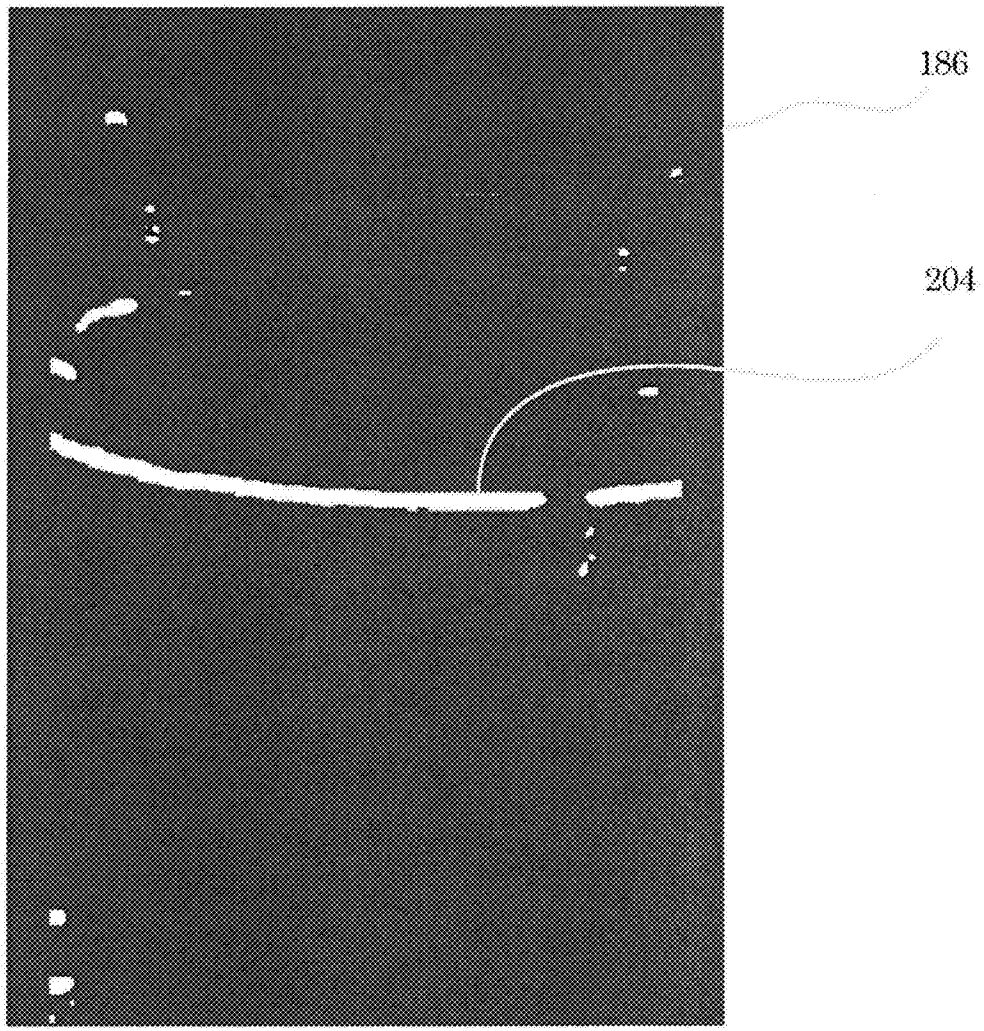

FIG. 14A shows a modified image 186 of the distortion corrected image 185. The distortion corrected image 185 may be modified using an edge detection algorithm, as shown in the modified image 186. Specifically, Sobel operation and masking in the y-direction were used to identify the liquid upper surface 204. A Sobel filter may be applied in the vertical direction for edge detection of the transition between beer 200 and foam 210. The image 185 has been filtered based on the magnitude of the gradient.

Figure 14B:
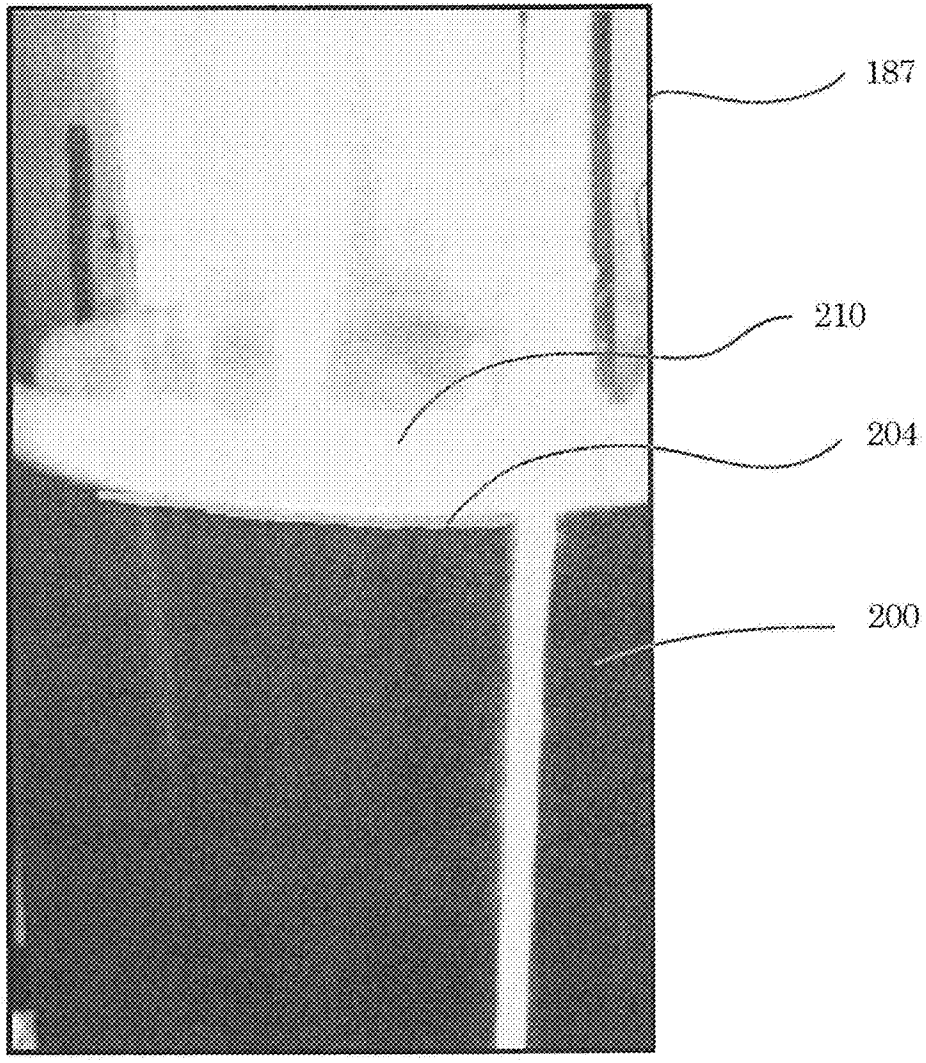

FIG. 14B shows a transformed image 187. A Hough transform has been applied to the undistorted image 185 to detect horizontal edges. The horizontal edge in the transformed image 187 is the liquid upper surface 204.

Figure 14C:
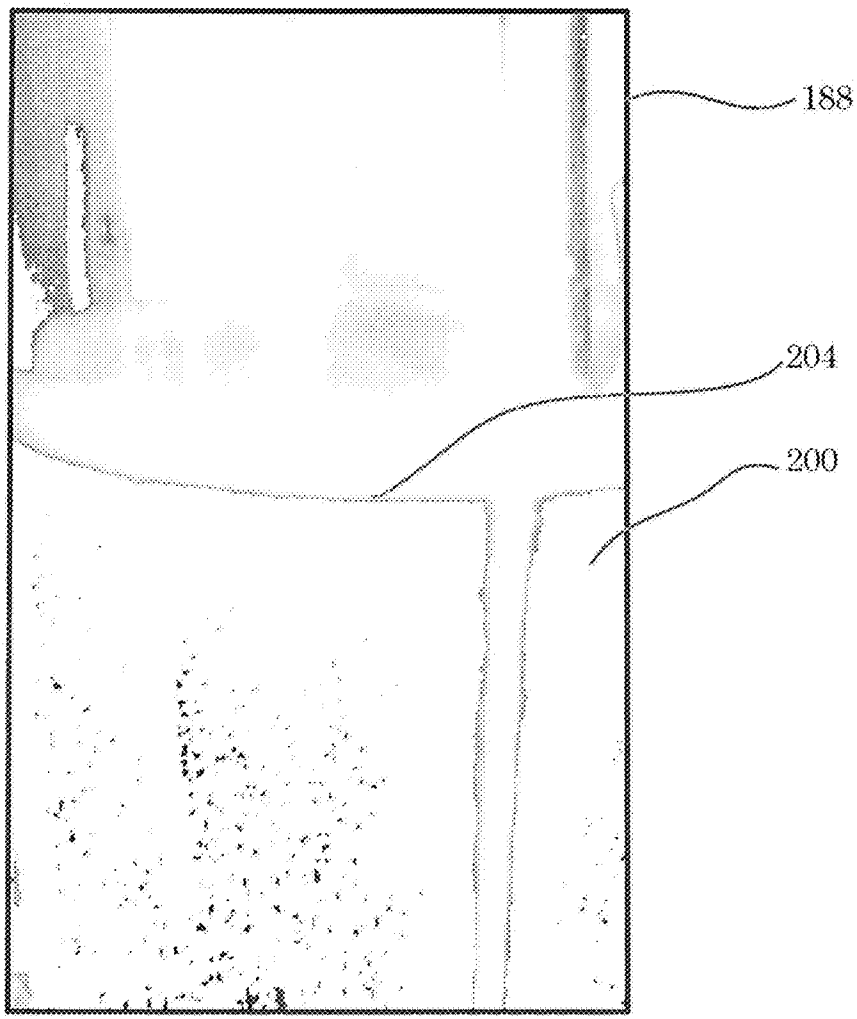

FIG. 14C shows a colour-filtered image 188. The colour-filtered image 188 may be used to determine the liquid upper surface 204. In this image, the beer 200 of the undistorted image 185 has been coloured a different colour than the rest of the image, which provides an indication as to where the liquid upper surface 204 is located.

Figure 15:
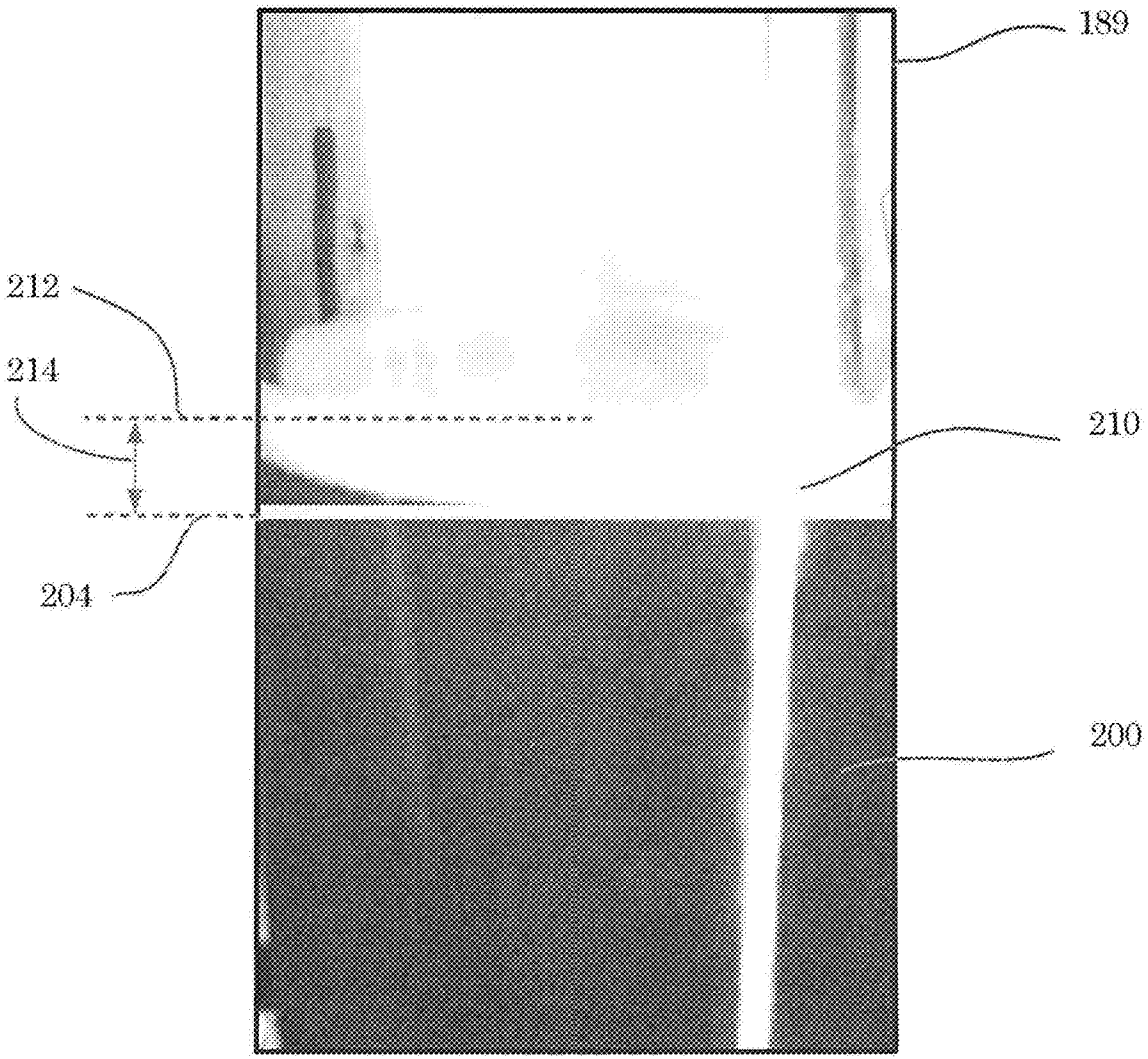

FIG. 15 shows a finished image 189. Once the liquid upper surface 204 has been identified in at least one of the undistorted image 185, the modified image 186, the transformed image 187, and the colour-filtered image 188, the processor notes its position on the finished image 189. The processor may then use the liquid upper surface 204 to calculate various distances as described herein.

It should be understood that the processor may use one or more of each of the undistortion, Sobel filter, Hough transform, and colour-filter operations during the image analysis process. For example, a value for the liquid upper surface 204 may be determined by each of the image analysis processes. The processor may then use each of these values for the liquid upper surface 204 to determine the most likely position of the liquid upper surface 204. The most likely position of the liquid upper surface 204 may then be used for calculations.

Figure 20:
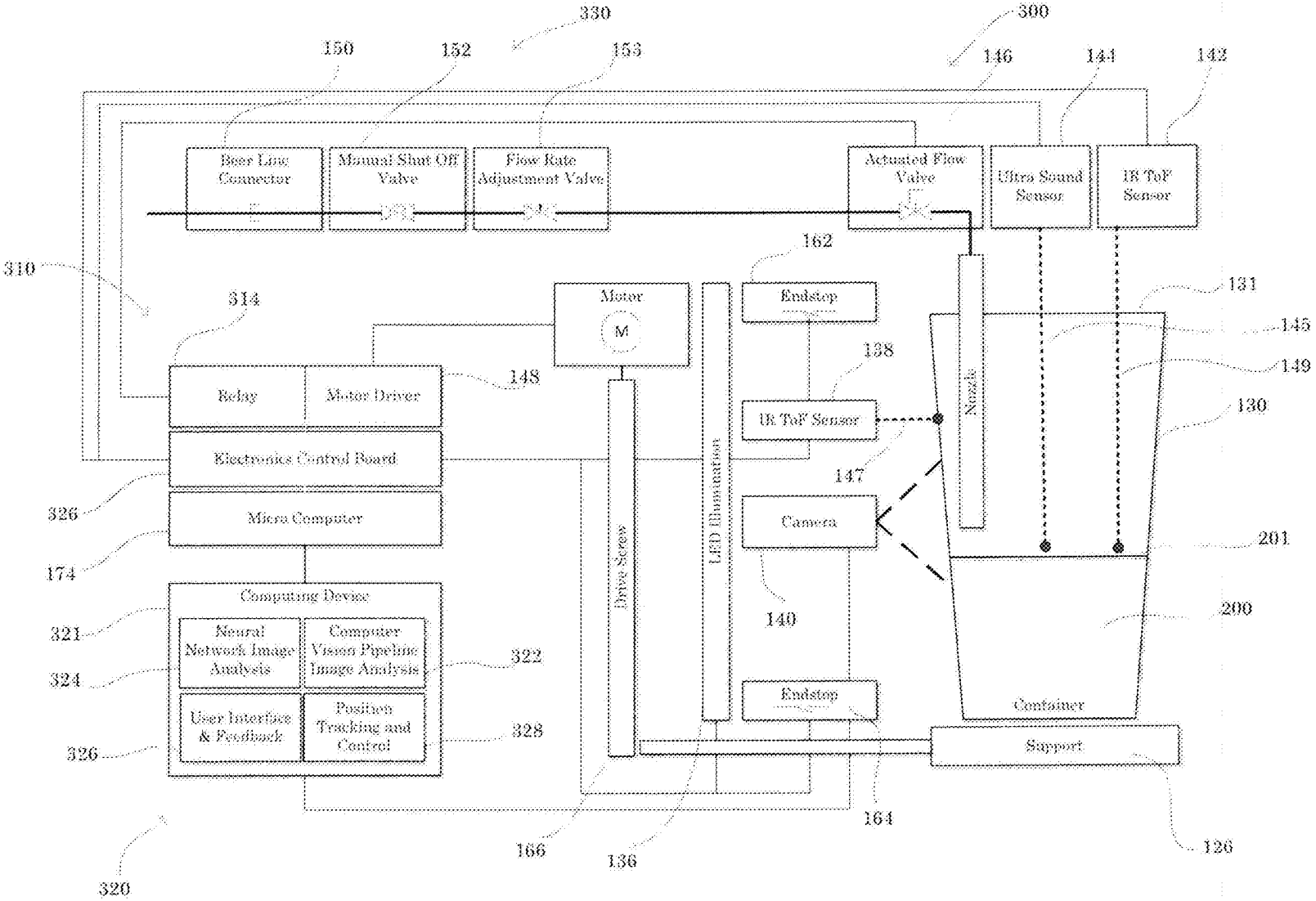
FIG. 20 shows an exemplary embodiment of a beer dispenser system.

Referring now to FIG. 20, shown therein is an exemplary embodiment of a beer dispenser system 300. System 300 represents a schematic illustration of the functionality of the beer dispenser 100. System 300 includes at least one imaging device. System 300 may have a plurality of imaging devices. As shown in FIG. 20, system 300 has a first infrared sensor 138 and a second infrared sensor 142. System 300 has a camera 140. System 300 has an ultrasound sensor 144.

System 300 includes an elevation system 156. The elevation system 156 may include a first end stop 162 and a second end stop 164. The elevation system 156 may include a support 126. The elevation system 156 may include a drive motor 148. The elevation system 156 may include a drive screw 166.

System 300 includes a control module 310. The control module 310 may include a MCU 174. The control module 310 may include a control board 312. The control board 312 may be coupled to the MCU 174. The control board 312 may be included in the MCU 174. The control module 310 may include a relay 314. The relay 314 may be coupled to the control board 312. The relay 314 may be used to open and close a fluid valve 146. The control module 310 may also include electronics for the motor driver 148.

In some embodiments, as exemplified, system 300 may include a computer vision module 320. The computer vision module 320 may be coupled to the control module 310. The computer vision module 320 may include a computing device 321. The computer vision module 320 may be trained through machine learning to identify regions of interest on the at least one image produced by the at least one imaging device. The computer vision module 320 may include at least one image analysis algorithm. The at least one image analysis algorithm may include a neural network 324. The image analysis algorithm may include a computer vision pipeline algorithm 322. The computer vision module 320 may include a display (not shown) on the computing device 321. The display on the computing device 321 may have a user interface and feedback visualization 326. The user interface and feedback visualization 326 may depict a field of view 141 of the camera 140. The user interface and feedback visualization 326 may also include any images produced by the at least one imaging device. The user interface and feedback visualization 326 may include a visual representation of analysis performed on the images produced by the at least one imaging device. The computer vision module 320 may include a position tracking and control algorithm 328. The position tracking and control algorithm 328 may be used to track and estimate the surface level of dispensed beer 200. The computer vision module 320 may be coupled to a data input terminal. The data input terminal may be a MCU USB connector 180. The data input terminal may be a camera USB connector 182.

System 300 includes a dispenser module 330. The dispenser module 330 may include a beer line connector 150. The beer line connector 150 may be coupled to a beer source (not shown). The dispenser module 330 may include a manual shut off 152. The dispenser module 330 may include a flow rate adjuster 153. The flow rate adjuster may control the rate of flow of the dispensed beer 200 from the beer line connector 150. The dispenser module 330 may include the fluid valve 146. The dispenser module may include a nozzle 128.

Referring now to FIGS. 16-19, shown therein are example images generated by the at least one imaging device of the beer dispenser 100. The processor (e.g. MCU 174 and/or the computing device) may use the computer vision module 320 to analyze the images generated by the at least one imaging device of the beer dispenser 100. The processor may use the neural network 324 to perform image analysis. For example, the computer vision module 320 may track the surface level of the dispensed beer 200 by using image data from the camera 140. As described above, the computer vision module 320 may use at least one image analysis algorithm. The image analysis algorithm may include the neural network 324 and/or the computer vision pipeline algorithm 322 as part of its image analysis. The at least one image analysis algorithm may use sharp gradients in the vertical direction of the image. These sharp gradients identify the transition between the container 130 and the beer 200. The at least one image analysis algorithm may also carry out colour filtering on the image. Colour filtering may identify regions, which match the target beer colour. The liquid upper surface 204 may be tracked and estimated through use of a moving average filter. The moving average filter may generate a region of interest 198 for the algorithm to target.

Figure 16:
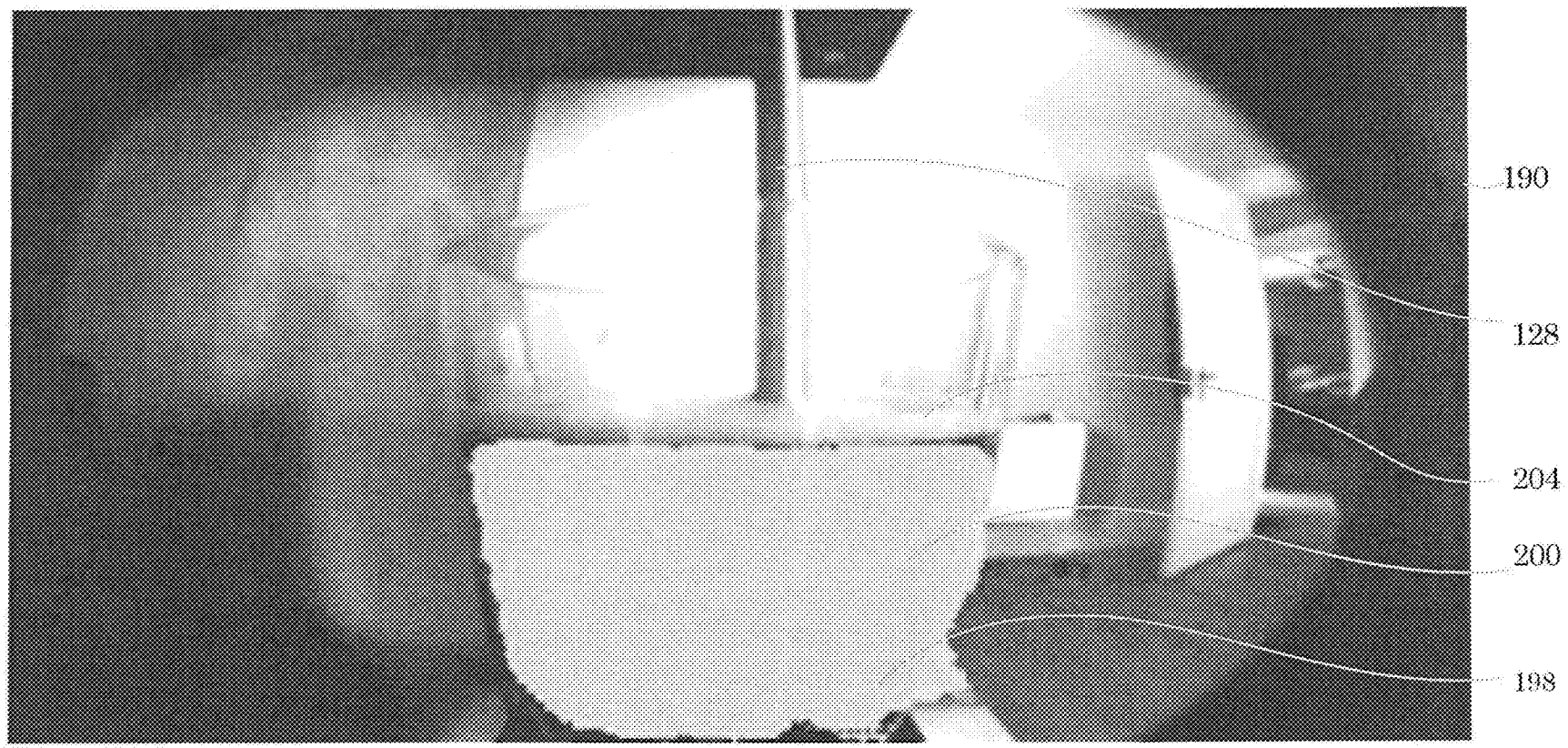
FIGS. 16-19 show exemplary images of the beer dispenser of FIG. 1.
Figure 17:
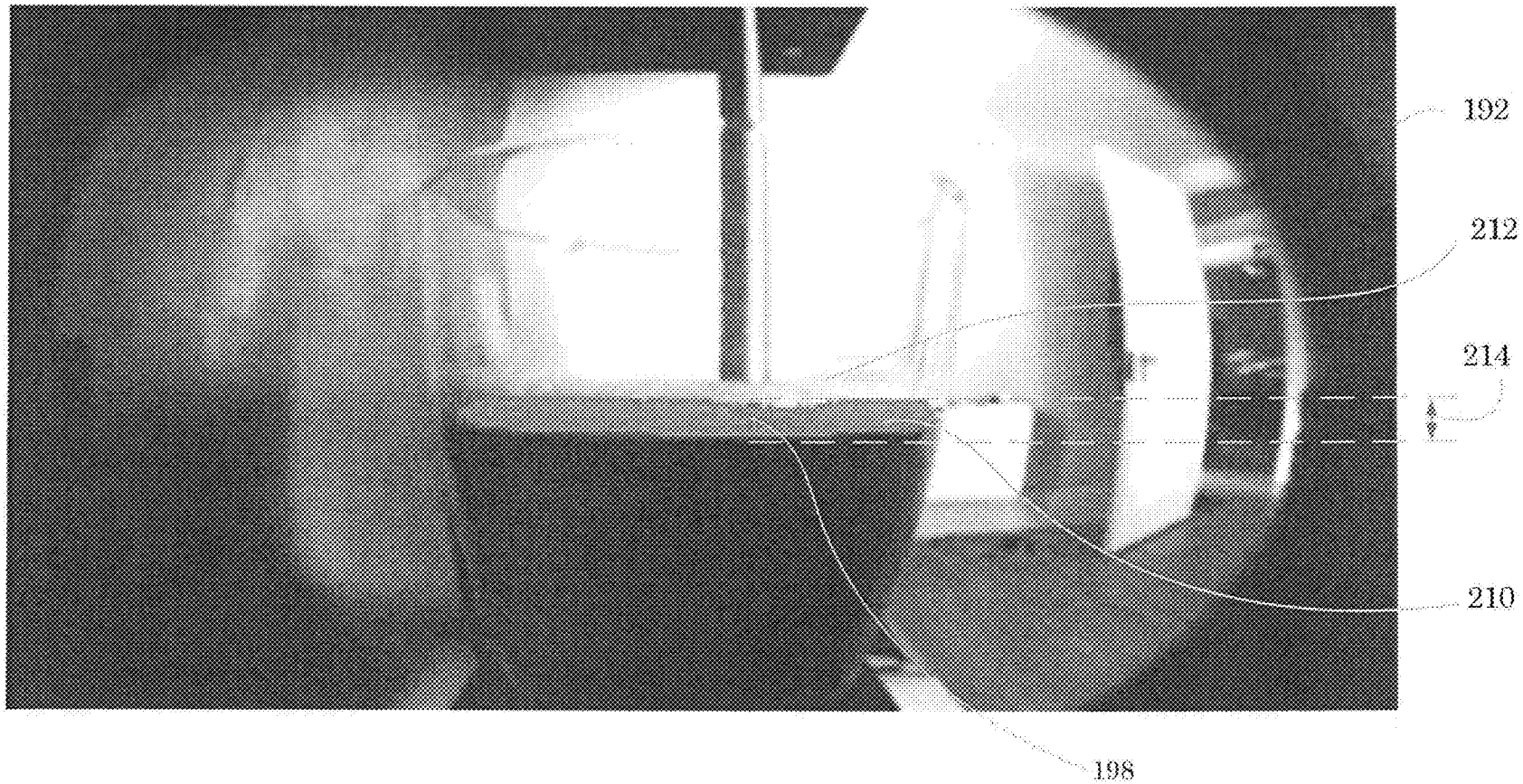
Figure 18:
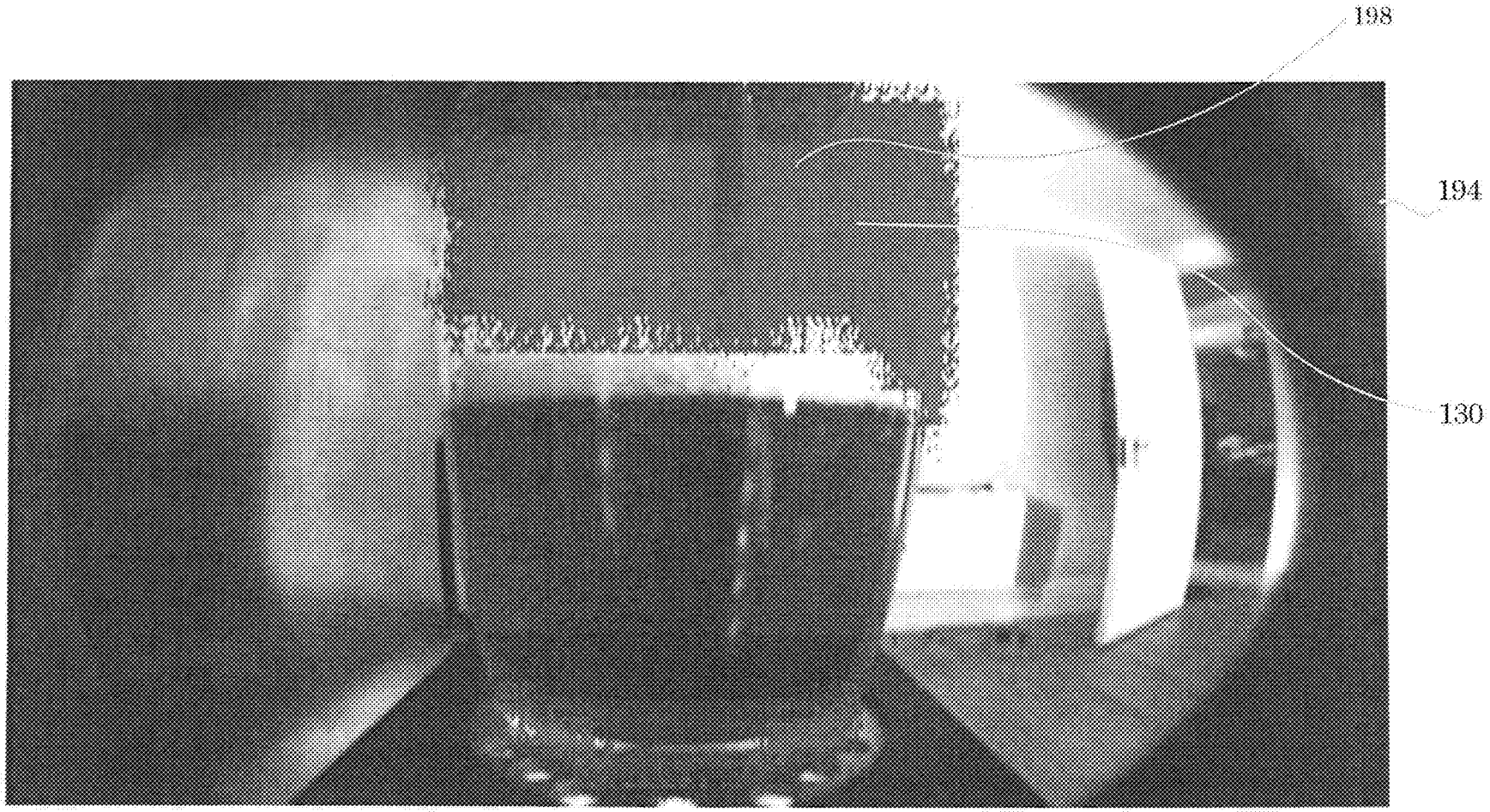
Figure 19:
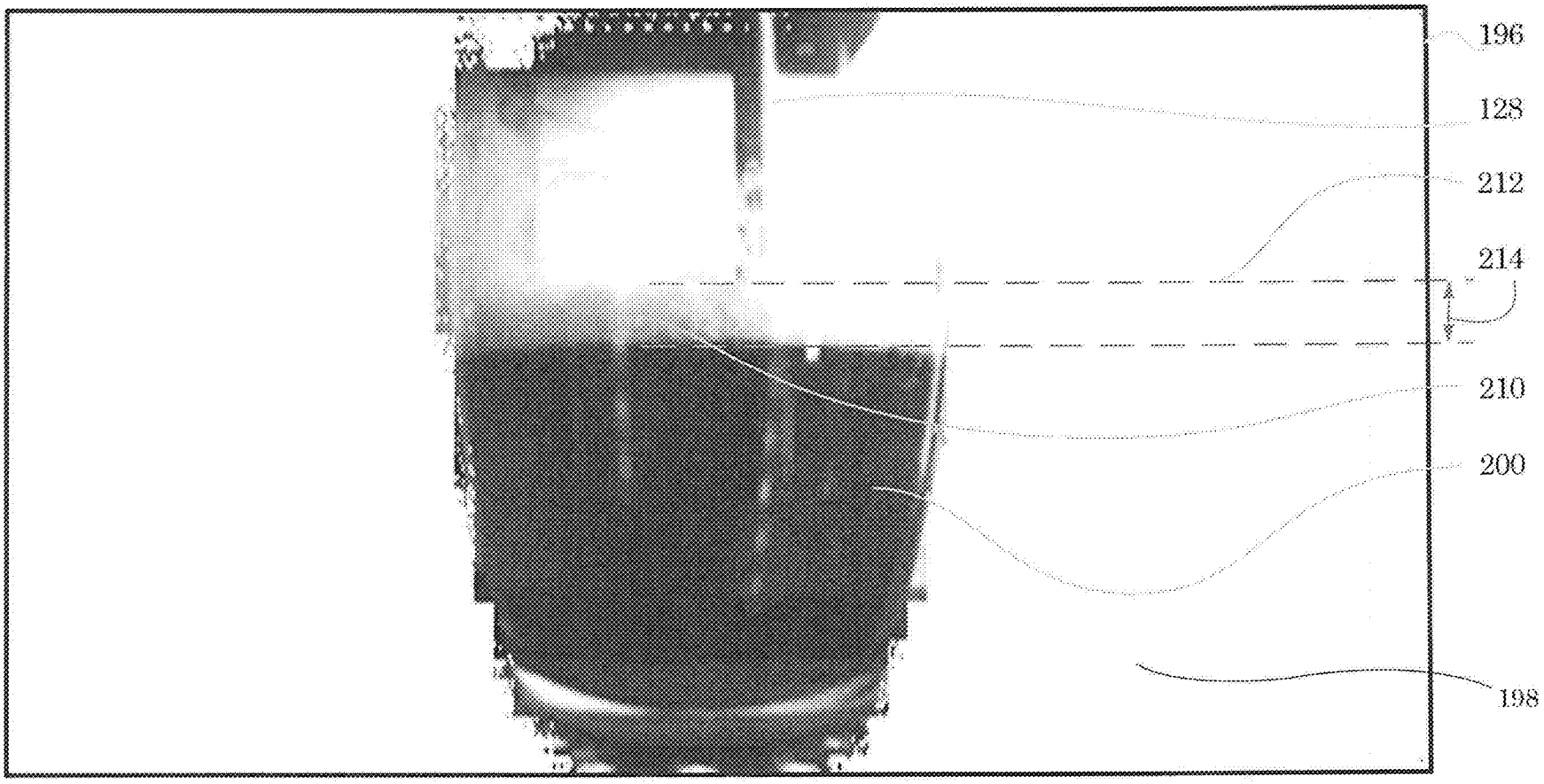

For example, FIG. 16 shows a beer image 190. The beer image 190 has been analyzed to identify the region 198 of the image 190 that represents dispensed beer 200. FIG. 17 shows a foam image 192. The foam image 192 has been analyzed to identify the region 198 of the image 192 that represents the foam 210. FIG. 18 shows a container image 194. The container image 194 has been analyzed to identify the region 198 of the image 194 that represents the container 130. FIG. 19 shows a background image 196. The background image 196 has been analyzed to identify the region 198 of the image 196 that does not include the container 130, the beer 200, and the foam 210. The background has been removed in the image 196.

The neural network 324 may be trained to perform semantic segmentation of images. The images may be received from the camera 140. Software in the neural network 324 may be capable of labelling regions of an image that correspond to at least one of the: background, container 130, beer 200, foam 210, and markings on the container 130. The neural network 324 may make use of full pixel labelling segmentation. Full pixel labelling segmentation may provide an effective means to label desired regions of the image. In some embodiments, the neural network 324 may only identify some of the background, container 130, beer 200, and/or foam 210. For example, the neural network 324 may identify only the foam 210 and the liquid upper surface 204.

Referring now to FIGS. 24-33, shown therein are exemplary illustrations that correspond to the images of FIGS. 13-19. FIGS. 24-33 show illustrations of the images taken by camera 140 to provide additional clarity to the image analysis process.

Figure 24:
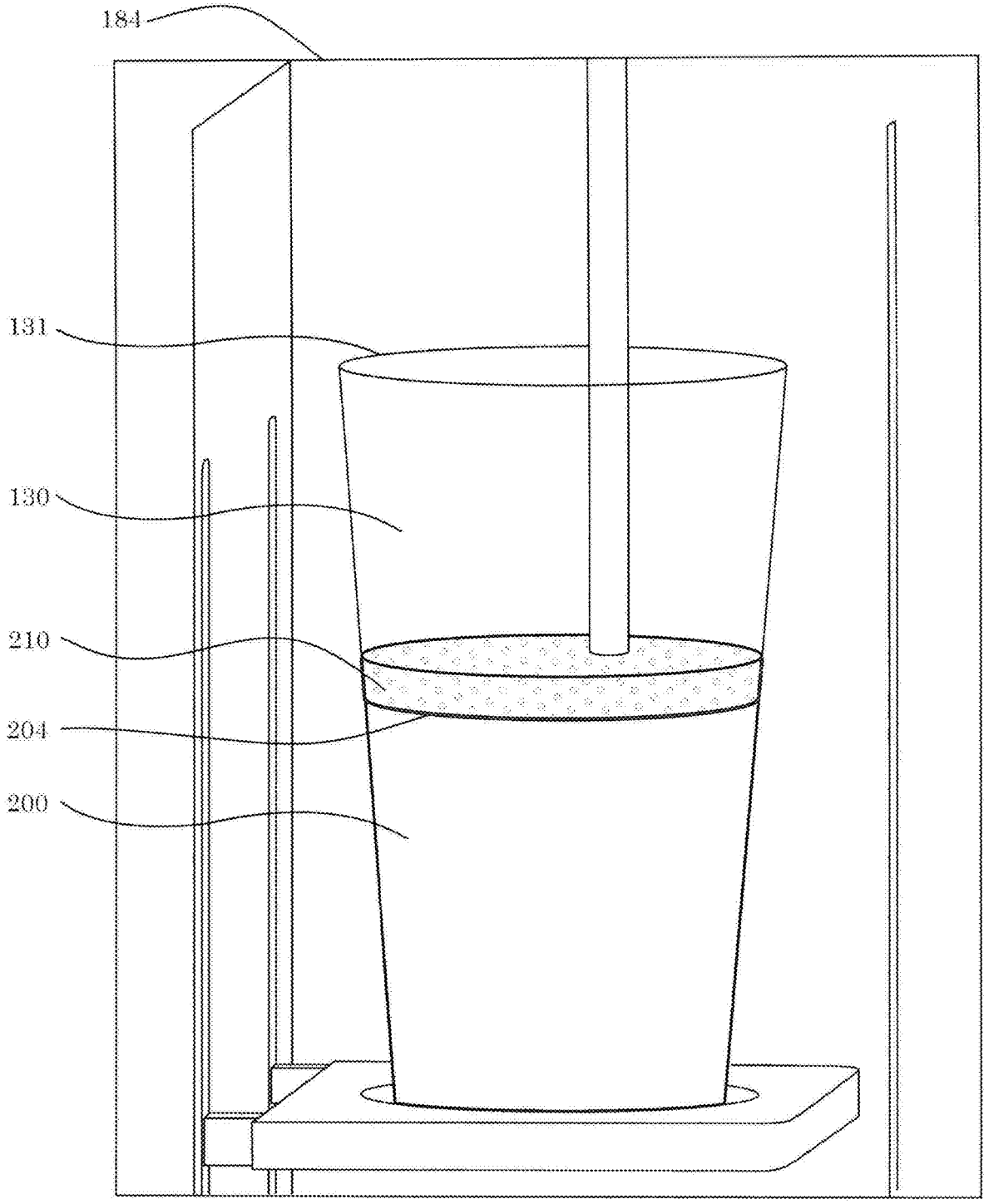
FIGS. 24-33 show exemplary illustrations of the images of FIGS. 13-19.

FIG. 24 shows an illustration of the base image 184, as exemplified in FIG. 13A. The solid line surrounding the elements of FIG. 24 indicates the border of the base image 184.

Figure 25:
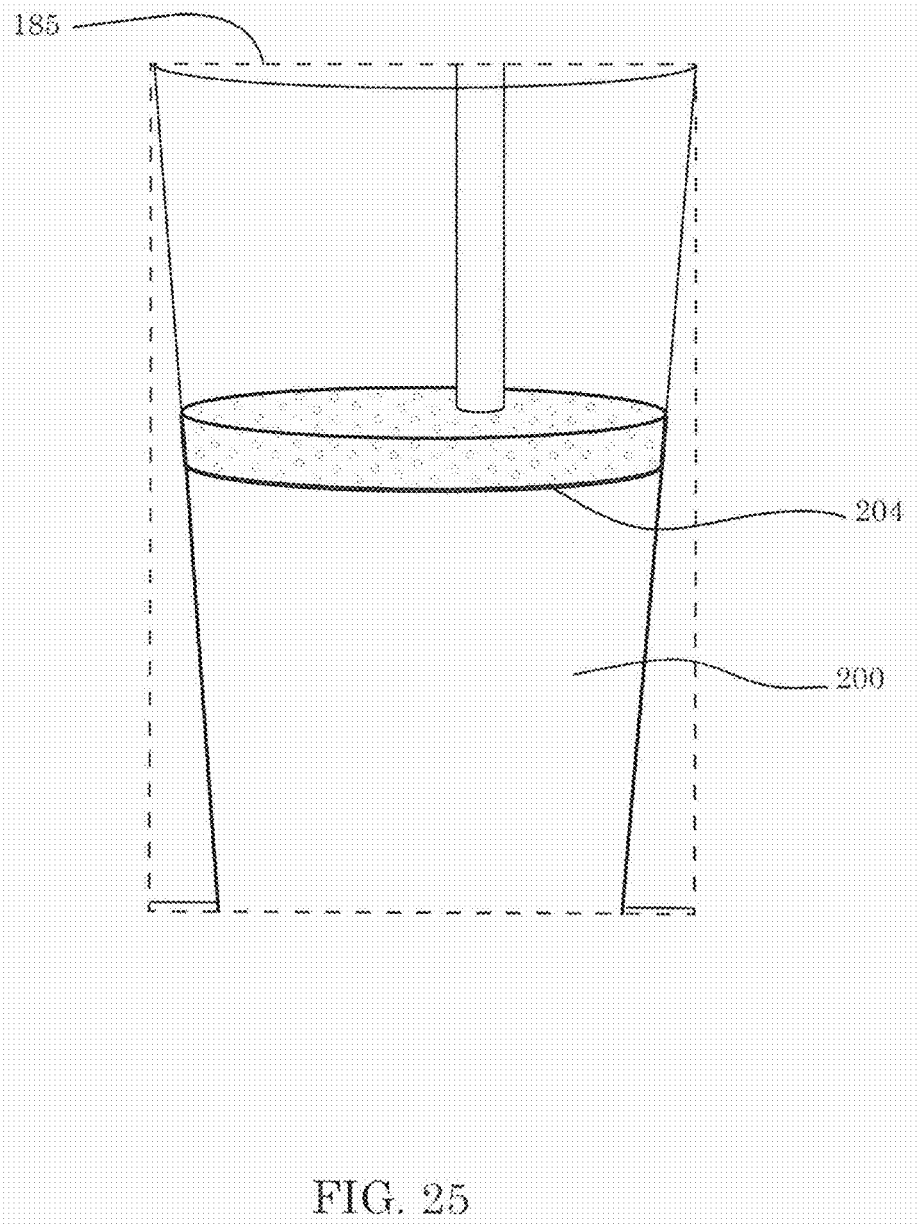

FIG. 25 shows an illustration of the undistorted image 185, as exemplified in FIG. 13B. As shown in FIG. 25, the base image 184 has been cropped to produce a smaller image size for the subsequent analysis of the undistorted image 185. The cropped sized is indicated by the dashed line border.

Figure 26:
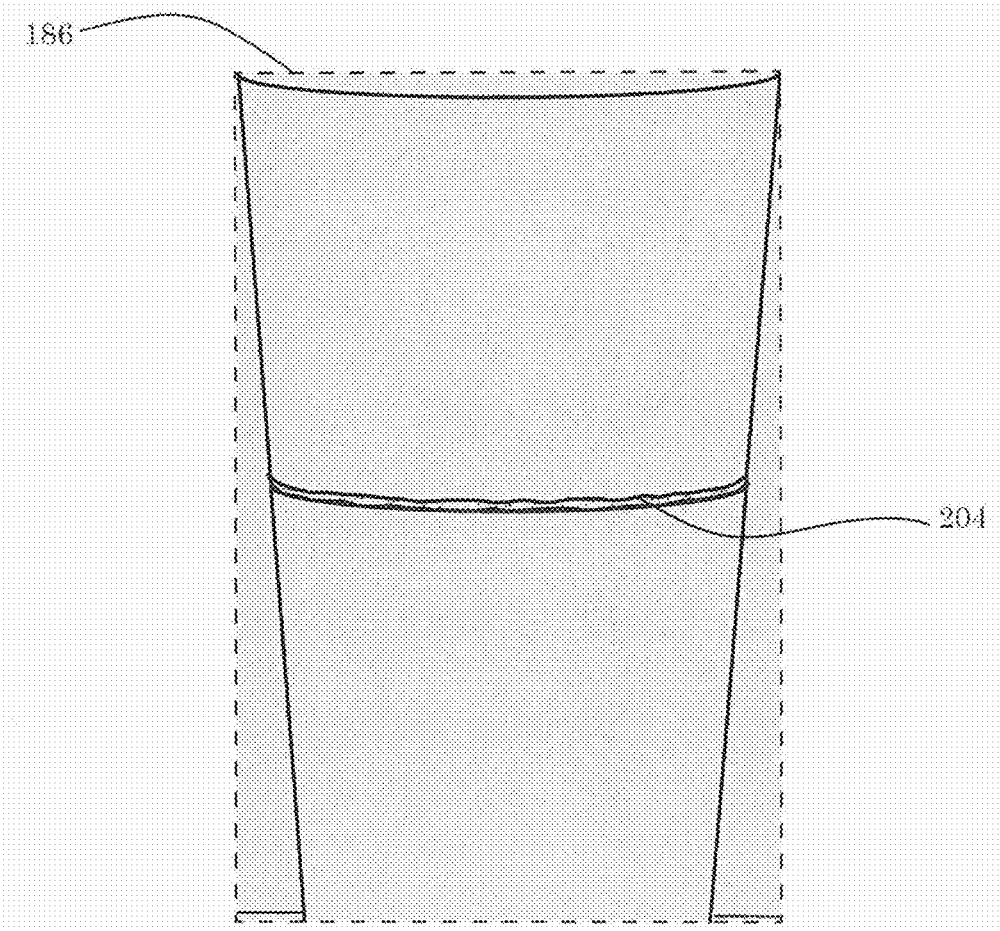

FIG. 26 shows an illustration of the modified image 186, as exemplified in FIG. 14A. As described above, Sobel operation and masking in the y-direction were used to identify the liquid upper surface 204.

Figure 27:
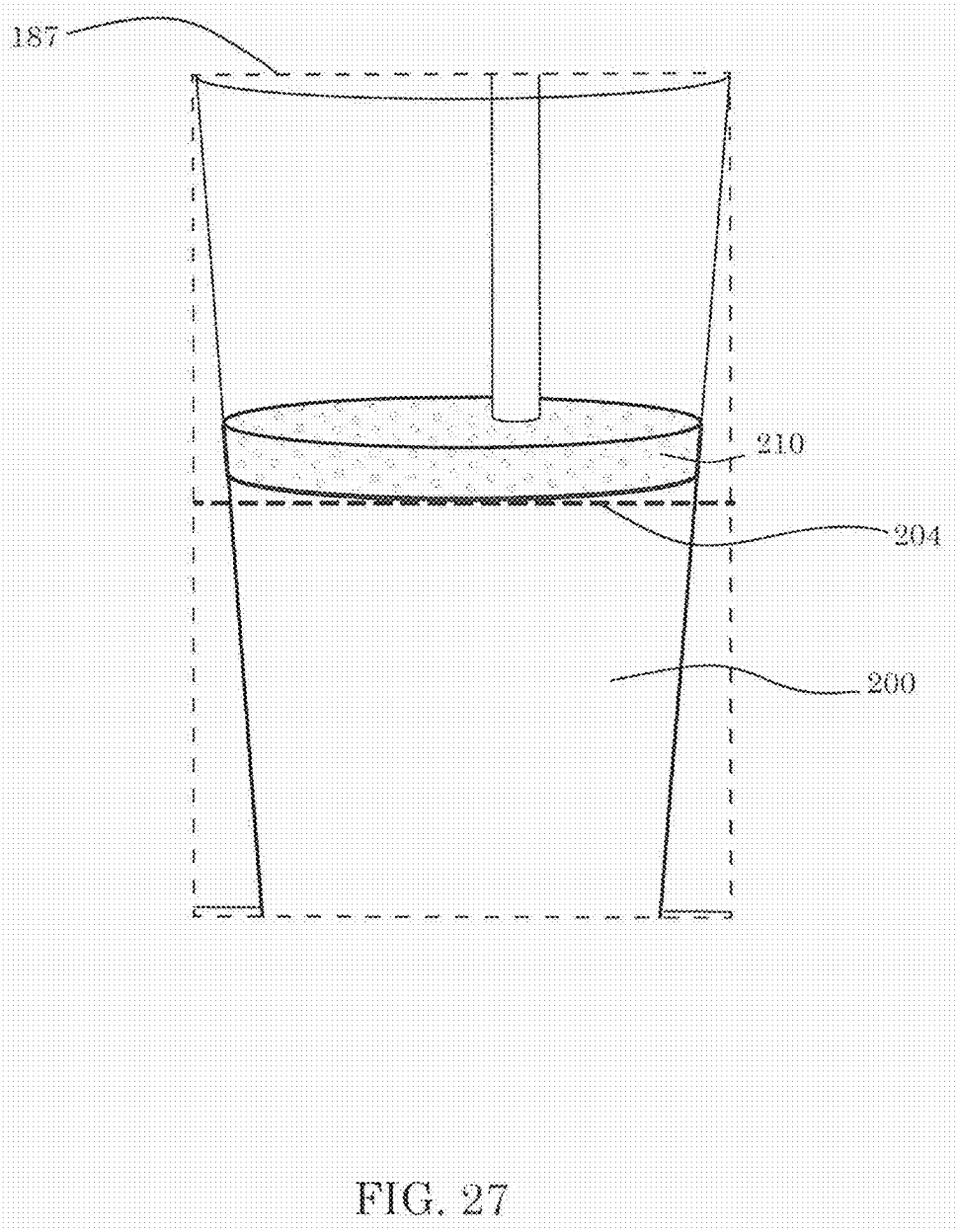

FIG. 27 shows an illustration of the transformed image 187, as exemplified in FIG. 14B. As described above, a Hough transform has been applied to detect horizontal edges. The horizontal edge in FIG. 27 is the liquid upper surface 204.

Figure 28:
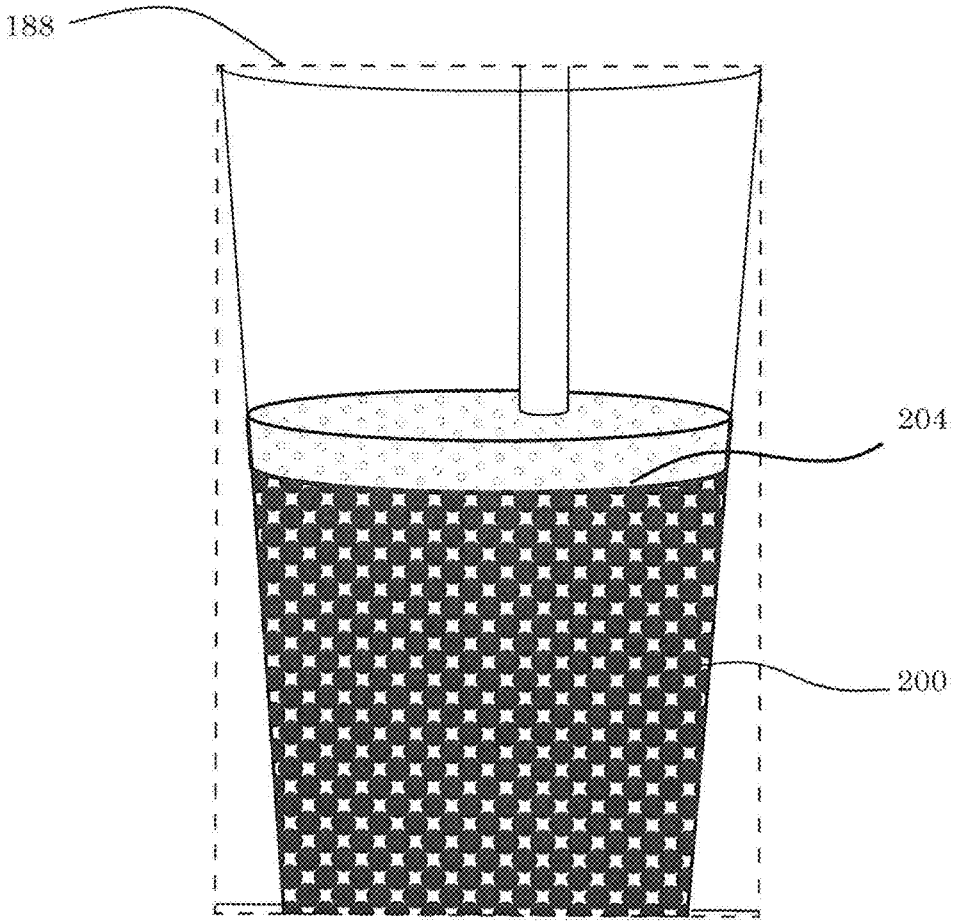

FIG. 28 shows an illustration of the colour-filtered image 188, as exemplified in FIG. 14C. As described above, the colour-filtered image 188 may be used to determine the liquid upper surface 204. As illustrated, the beer 200 has been coloured a different colour than the rest of the illustration, which provides an indication as to where the liquid upper surface 204 is located.

Figure 29:
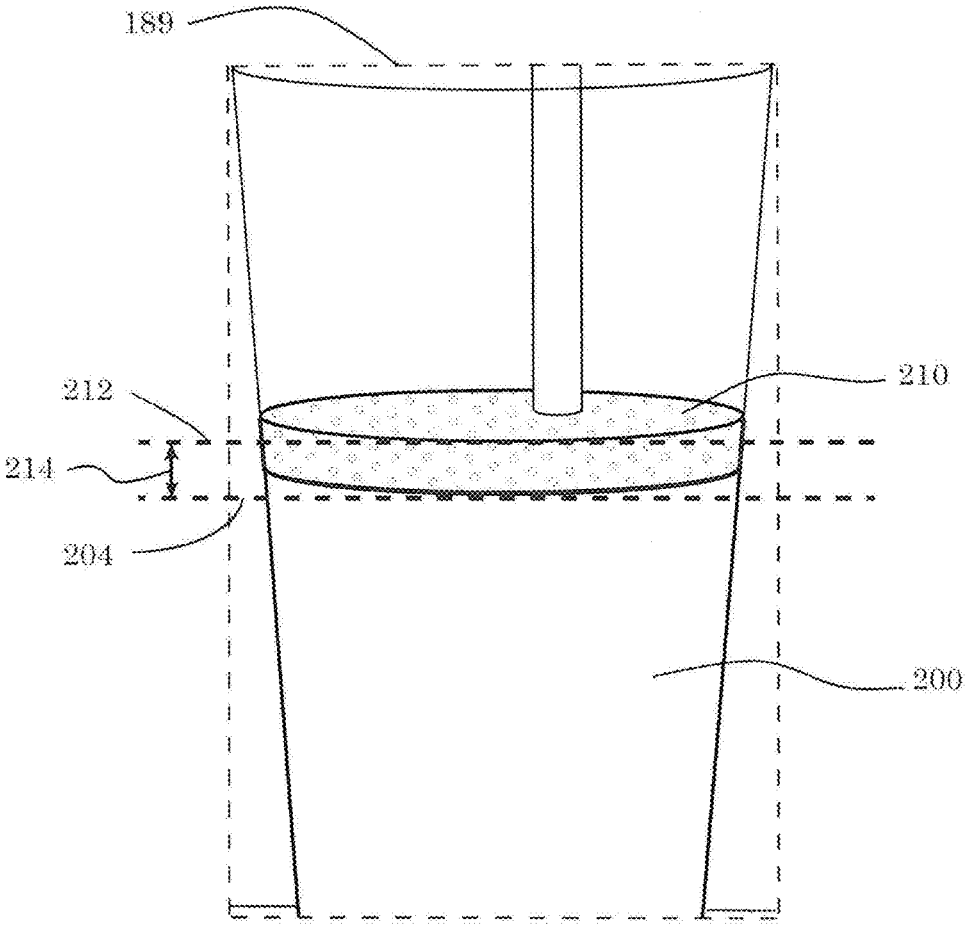

FIG. 29 shows an illustration of the finished image 189, as exemplified in FIG. 15. The illustration of the finished image 189 shows the liquid upper surface 204 and the foam top surface 212, The processor may then use the liquid upper surface 204 to calculate various distances as described herein. For example, as shown in FIG. 29, the processor indicates the measured foam height 214.

Figure 30:
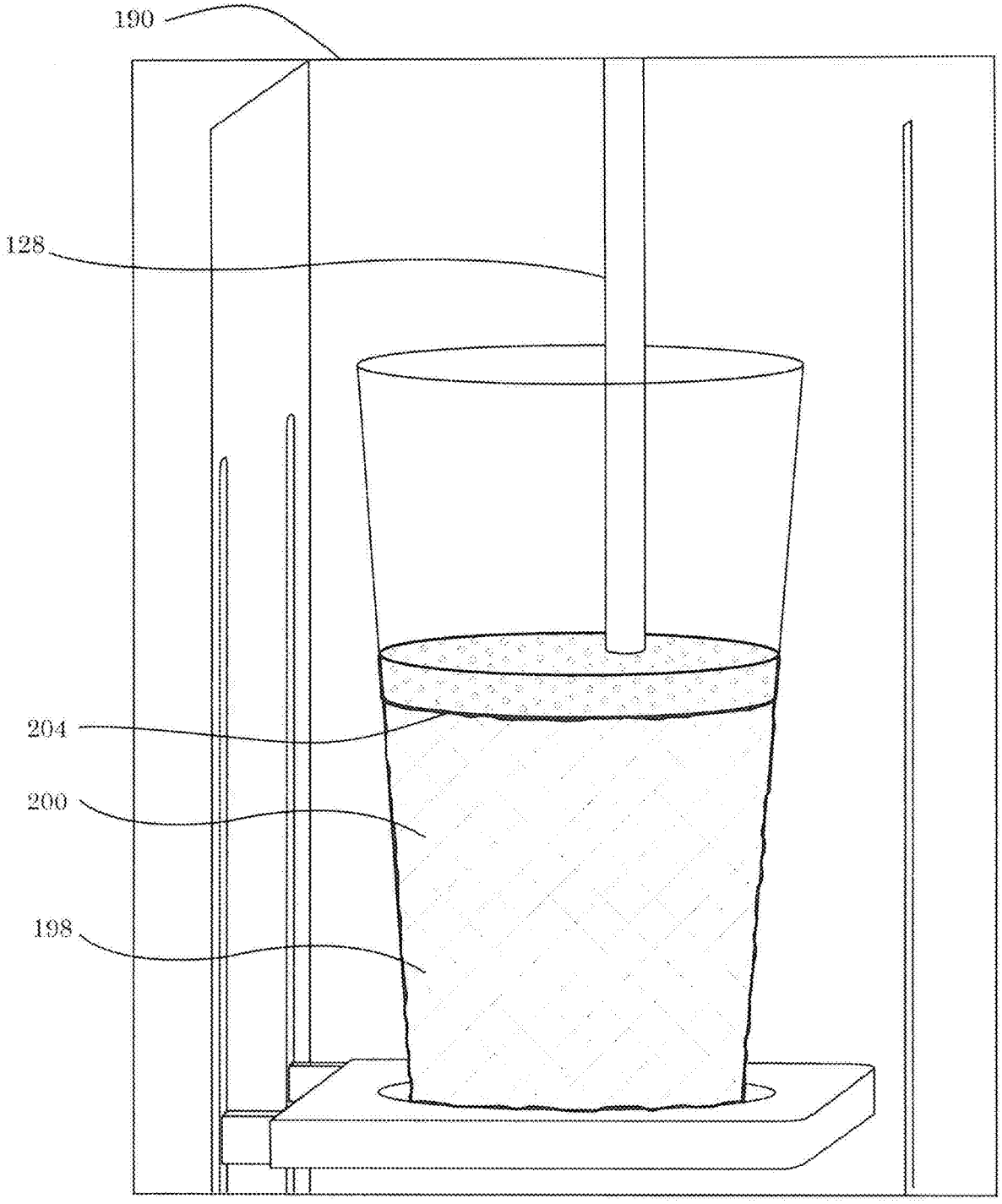

FIG. 30 shows an illustration of the beer image 190. As described above, the computer vision module 320 has used at least one image analysis algorithm to identify a region 198 for the algorithm to target. For example, as shown in FIG. 30, the region 198 indicates the region of the image 190 that corresponds to beer 200.

Figure 31:
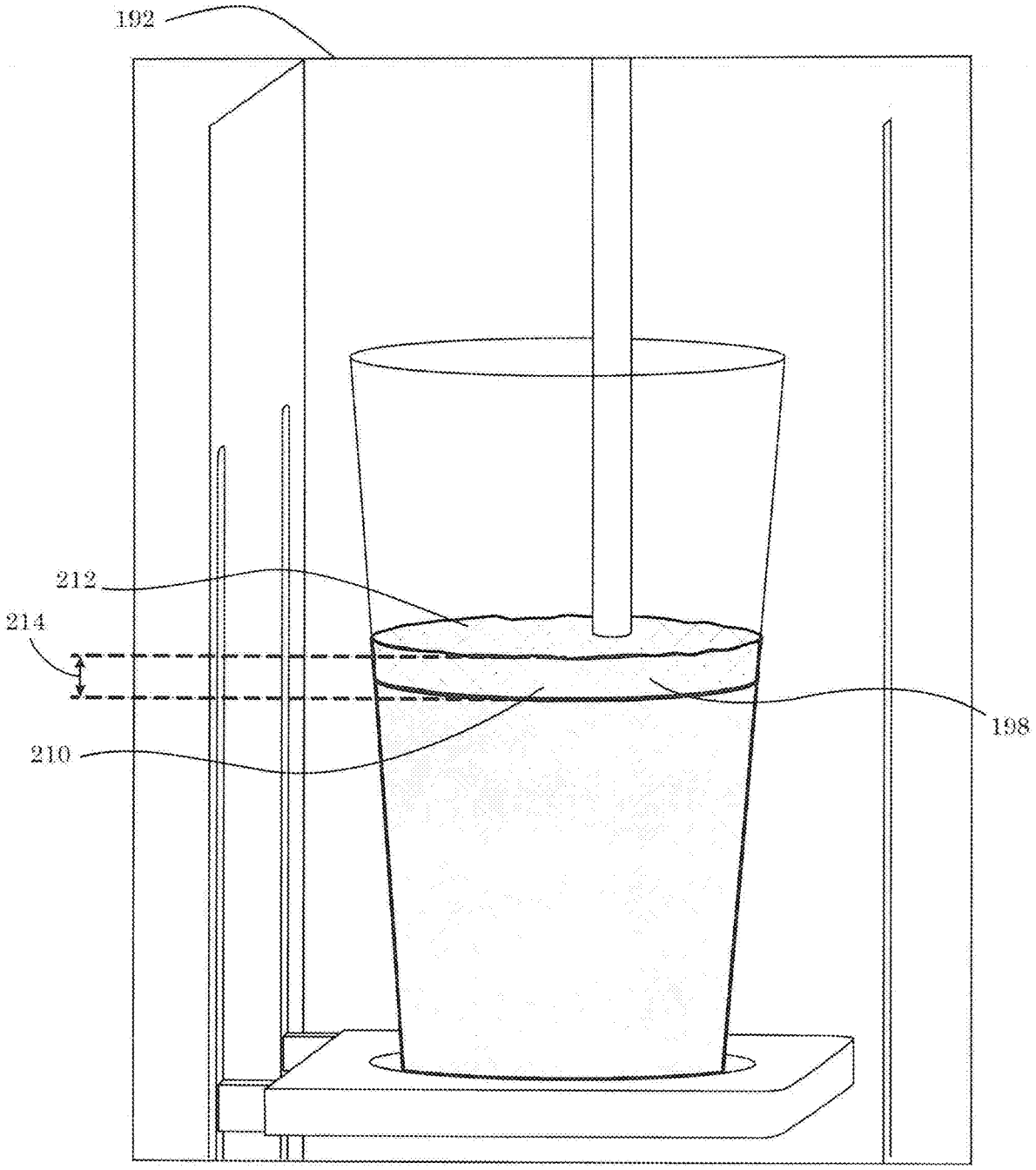

FIG. 31 shows an illustration of the foam image 192. As exemplified in FIG. 31, the region 198 of the image 192 corresponds to the foam 210.

Figure 32:
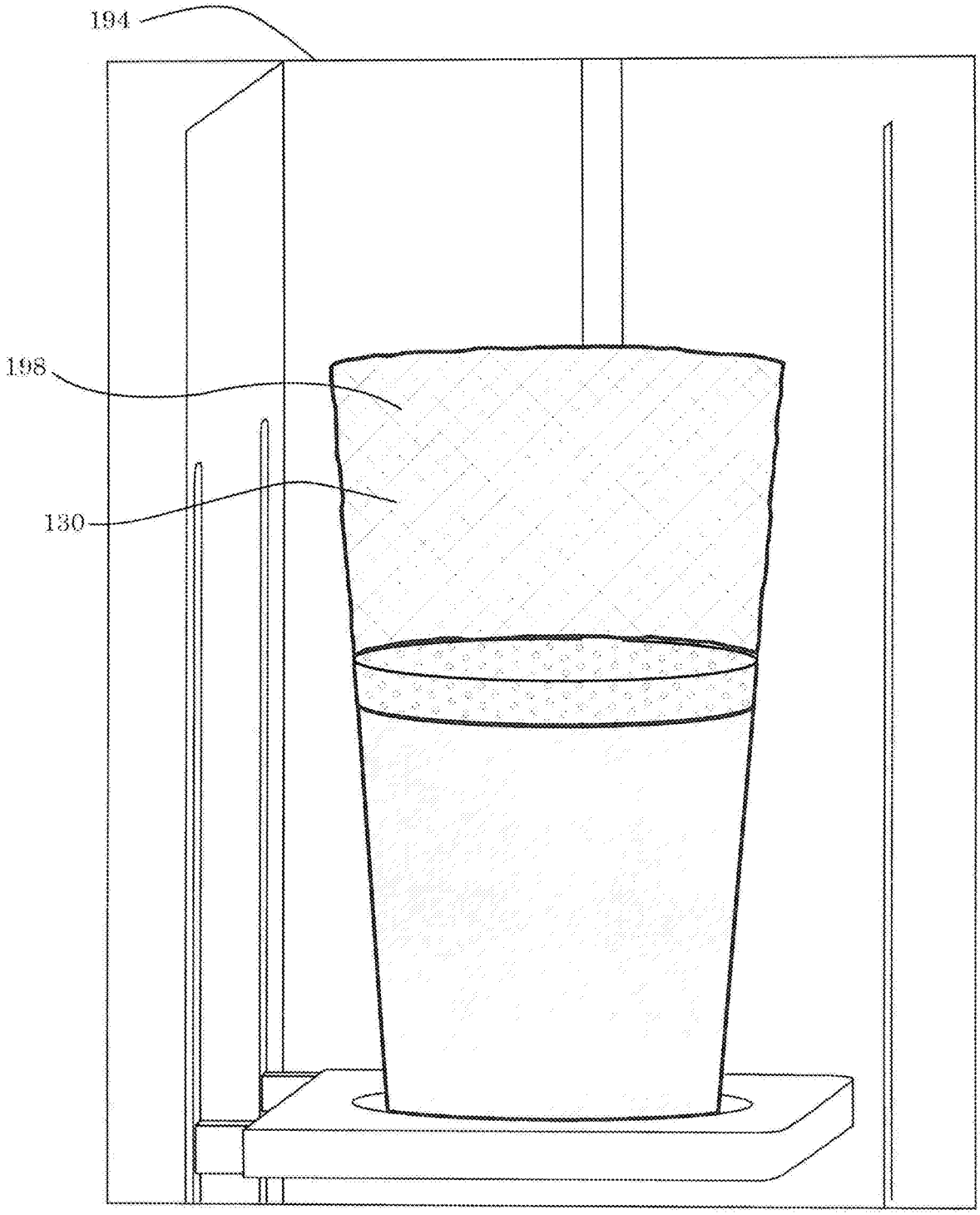

FIG. 32 shows an illustration of the container image 194. As exemplified in FIG. 32, the region 198 of the image 194 corresponds to the container 130.

Figure 33:
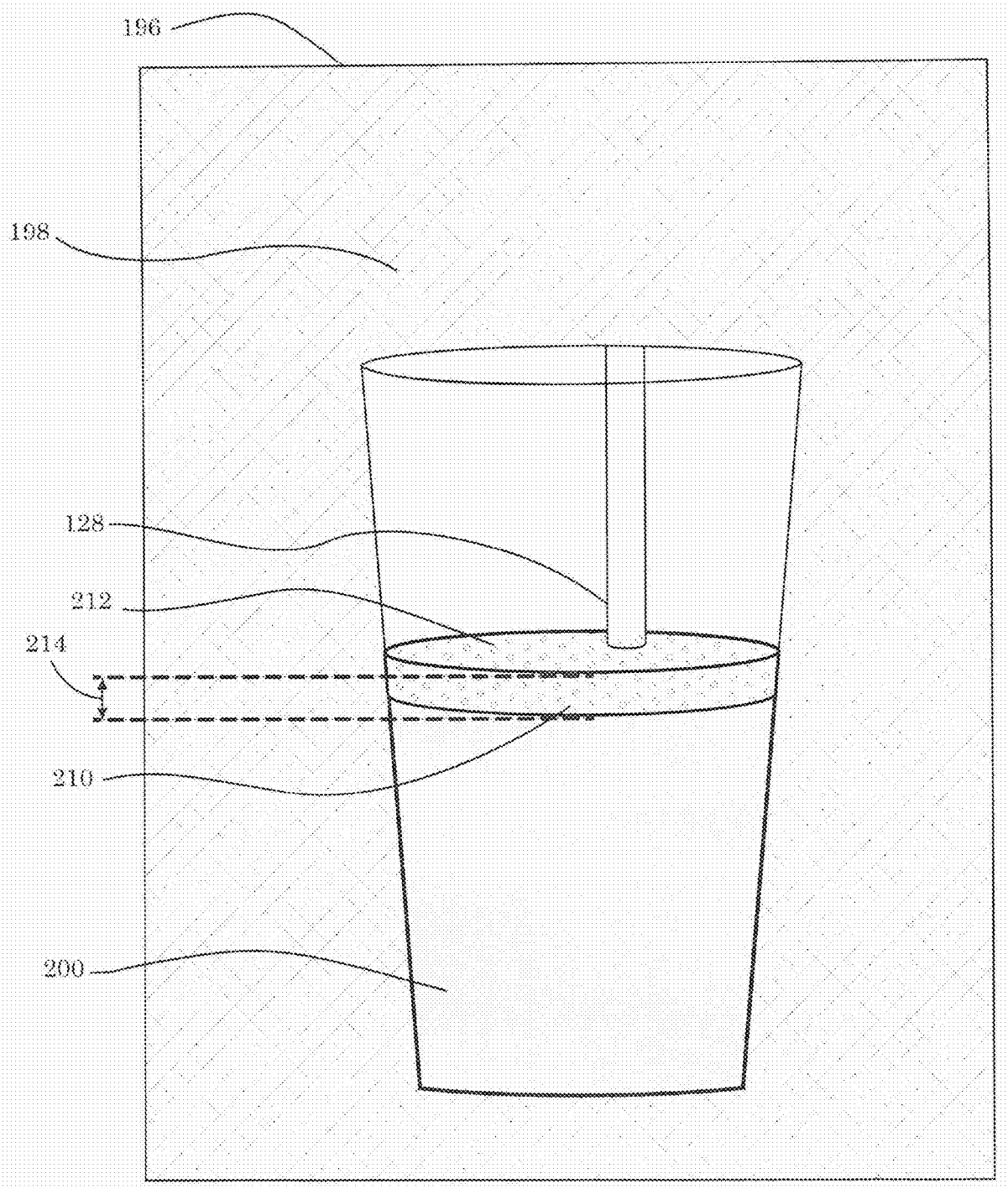

FIG. 33 shows an illustration of the background image 196. As exemplified in FIG. 33, the region 198 identifies the background portion of the image 196, or, in other words, the area that does not include 130, the beer 200, and the foam 210. The background has been removed in the image 196.

Figure 21:
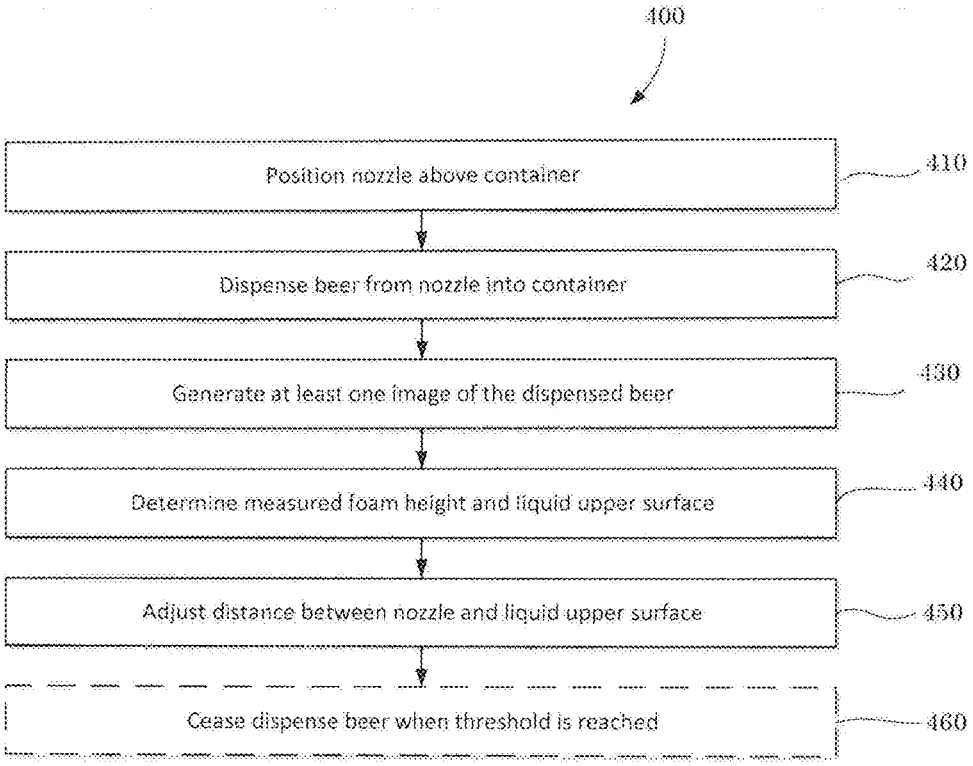
FIG. 21 shows an exemplary method of dispensing beer.

Referring now to FIG. 21, shown therein is example embodiment of a method of dispensing beer 400 using the beer dispenser 100 as described herein.

At act 410, the nozzle 128 is positioned above the container 130. Act 410 may include positioning the nozzle 128 above the container 130. Act 410 may also include using the support 126 to receive the container 130. When the support 126 has received the container 130, the nozzle 128 is positioned above the container 130. In some embodiments, act 410 includes positioning the container 130 into a start position. The distance 202 between the nozzle 128 and the container bottom 133 may be determined using the position sensor. Act 410 may also include determining the position of the container rim 133 using the rim sensor.

At act 420, beer 200 is dispensed from the nozzle 128 into the container 130.

At act 430, at least one image of the dispensed beer 200 is generated using the at least one imaging device. The at least one image of the dispensed beer may be generated by using at least one of an ultrasound sensor 144, an infrared sensor 138 or 142, and a camera 140.

At act 440, the foam height 214 and liquid upper surface 204 are determined by using the at least one image of the dispensed beer 200. The foam height 214 is measured. Act 440 may also include determining a difference between the measured foam height 214 and a desired foam height. In some embodiments, the desired foam height may be stored in a memory device.

At act 450, the distance 206 between the nozzle 128 and the liquid upper surface 204 is adjusted to control the measured foam height 214. Act 450 may also include adjusting the distance 206 between the nozzle 128 and the liquid upper surface 204 as the beer 200 is dispensed to reduce the difference between the measured foam height 214 and the desired foam height. The elevation system 156 may be used to adjust the distance between the nozzle 128 and the liquid upper surface 204. In some embodiments, act 450 may include adjusting the distance 206 between the nozzle 128 and the liquid upper surface 204 by changing the position of the nozzle 128 with the elevation system 156. In some embodiments, act 450 includes adjusting the distance 206 between the nozzle 128 and the liquid upper surface 204 by changing the position of the support 126 with the elevation system 156. In some embodiments, act 450 may include adjusting the distance 206 between the nozzle 128 and the liquid upper surface 204 by changing at least one of the position of the support 126 and the nozzle 128 with the elevation system 156.

At optional act 460, the position of the container rim 131 is determined from the at least one image. The distance 218 between the container rim 131 and the liquid upper surface 204 is calculated. When the distance 218 between the container rim 131 and the liquid upper surface reaches a threshold, the dispensing of beer 200 is ceased. The elevation system 156 may then lower the container 130. The container 130 may then be removed from the beer dispenser 100.

In some embodiments, the method 400 may include measuring the volume of the dispensed beer 200 using a flow measurement device.

In some embodiments, the method 400 may include dispensing beer through a second nozzle. The beer dispensed through the second nozzle may be the same beer. The beer dispensed through the second nozzle may be a different beer. It will be appreciated that any number of additional nozzles may be used to dispense a corresponding number of beers.

In some embodiments, the method 400 may include illuminating the beer dispenser 100 using at least one light source 136.

Figure 22:
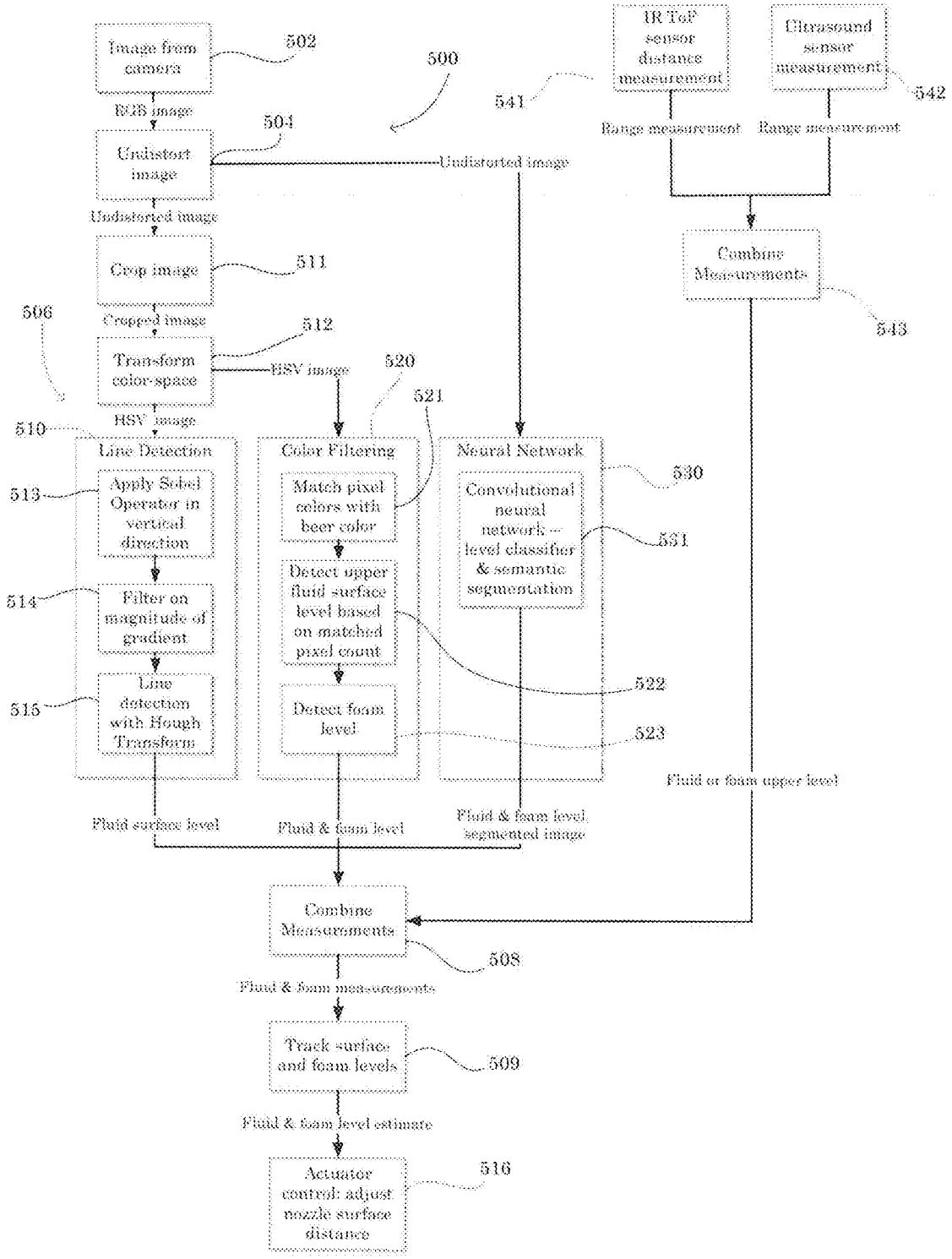
FIG. 22 shows an exemplary method of using computer vision for image analysis.

Referring now to FIG. 22, shown therein is an exemplary method 500 for using computer vision and or sensors to track the liquid upper surface 204.

At act 502, an image is generated by the at least one imaging device. The image is sent to the at least one processor. As described above, the at least one processor may be the MCU 174 or the computing device 321.

At act 504, the image is undistorted to account for lens distortion.

At act 506, the image is analyzed to determine at least one measurement for at least one of the liquid upper surface 204 and the measured foam height 214. Image analysis may include at least one of line detection, colour filtering, and a neural network. It should be understood that the image analysis 506 may use one or more of acts 510, 520, and 530.

At act 508, if a plurality of measurements has been determined in act 506, the measurements are combined. The measurements may be averaged.

At act 509, the liquid upper surface 204 and/or the measured foam height 214 is determined. The value for the liquid upper surface 204 and/or the measured foam height 214 may be compared against a desired value, as described herein.

At act 516, an output may be generated and sent to the MCU 174 to control the distance 206 between the liquid upper surface 204 and the nozzle 128 using the elevation system 156. In some embodiments, the measured foam height 214 may be adjusted using the fluid valve 146 to increase or decrease the flow of beer 200.

At act 510, line detection analysis is performed. The image is cropped at act 511. The image is then transformed to HSV colour-space at act 512. A Sobel operator is performed in the vertical direction at act 513. A filter is applied based on the magnitude of the gradient between the foam and the liquid at act 514. A Hough transform is applied to detect the edge of the liquid, or the liquid upper surface 204, at act 515. The measurement of the liquid upper surface 204 is then used in act 508.

At act 520, colour filtering is performed. After the image has been transformed to HSV colour-space at act 512, the colour-space image is filtered based on colour and intensity at act 521. The liquid upper surface 204 is then detected at act 522. The measurement of the liquid upper surface 204 is then used in act 508.

Figure 23:
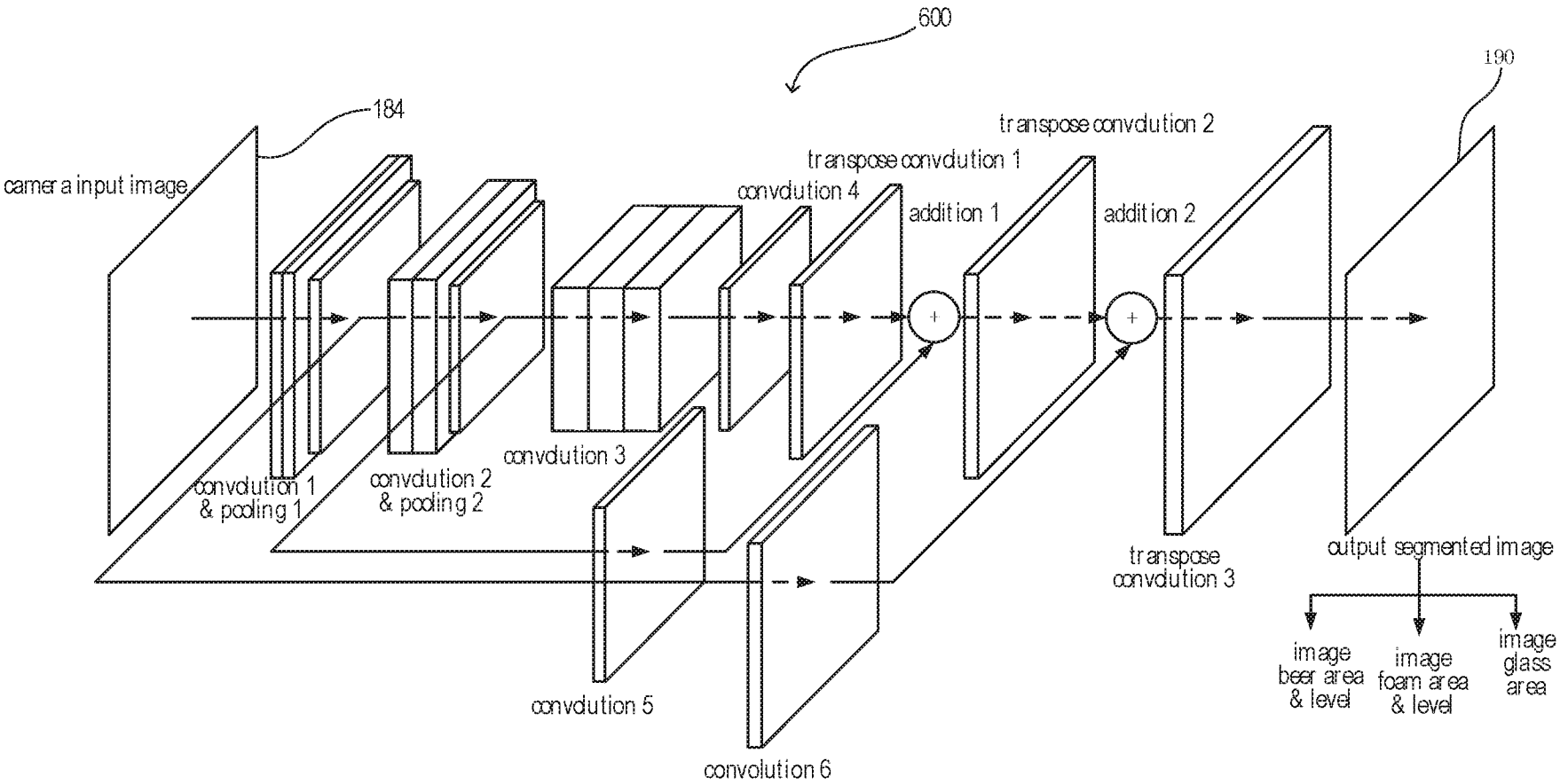
FIG. 23 shows an exemplary embodiment of a neural network architecture.

At act 530, the neural network 324 is used to conduct image analysis. A convolutional neural network is used for semantic segmentation at act 531. For example, FIG. 23 illustrates a neural network architecture 600. The neural network architecture 600 performs convolution on an image generated by the at least one imaging device. As shown in FIG. 23, pooling may be performed on the various images. Pooling may be performed at the same time as the convolutions or in a separate step. In some embodiments, as shown in FIG. 23, transposed convolutions may also be performed on the various images. For example, the base image 184 may be used, as shown in the neural network architecture 600. Semantic segmentation is then performed. The neural network 324 may then identify at least one of the beer 200, the container 130, the foam 210, and the background of the image. An image may then be output with the corresponding region identified. For example, the output image shown in FIG. 23 is the beer image 190. Based on the analysis, a measurement for the liquid upper surface 204 is generated. The measurement is used in act 508.

At acts 541 and 542, range measurements of the upper fluid surface are recorded from the overhead ultrasound sensor 144 and the overhead infrared sensor 142. It will be appreciated that the method 500 may use the range sensors and/or the computer vision to determine the measurements. For example, these range measurements are combined at act 543 and may be used at act 508 to determine range measurements in combination with, or in place of, the measurements from 510, 520, 530. In some embodiments, the method 500 may function with only computer vision acts 510, 520, 530. In some embodiments, the method 500 may function with only with sensor range measurements 541 and 542. In some embodiments, the method 500 may function with both computer vision acts 510, 520, 530 and sensor range measurements 541 and 542.

While the applicant's teachings described herein are in conjunction with various embodiments for illustrative purposes, it is not intended that the applicant's teachings be limited to such embodiments. On the contrary, the applicant's teachings described and illustrated herein encompass various alternatives, modifications, and equivalents, without departing from the embodiments described herein, the general scope of which is defined in the appended claims.

The invention claimed is:

1. A beer dispenser comprising:

a nozzle for positioning above a container and dispensing beer into the container;

at least one imaging device for generating at least one image of the dispensed beer; and a processor configured to:

determine a measured foam height and a liquid upper surface from the at least one image of the dispensed beer;

adjust a distance between the nozzle and the liquid upper surface as the beer is dispensed to control the measured foam height;

determine a difference between the measured foam height and a desired foam height; and adjust the distance between the nozzle and the liquid upper surface as the beer is dispensed to reduce the difference between the measured foam height and the desired foam height.

2. The beer dispenser of claim 1, further comprising an elevation system for adjusting the distance between the nozzle and the liquid upper surface.

3. The beer dispenser of claim 2, wherein the elevation system is coupled to the nozzle for adjusting the distance between the nozzle and the liquid upper surface by changing the position of the nozzle.

4. The beer dispenser of claim 1, further comprising a support for receiving the container and an elevation system coupled to the support for adjusting the distance between the nozzle and the liquid upper surface by changing the position of the support.

5. The beer dispenser of claim 4, wherein the elevation system is coupled to both the nozzle and the support for changing the distance between the nozzle and the liquid upper surface of the beer by changing the position of at least one of the nozzle and the support.

6. The beer dispenser of claim 1, further comprising a flow measurement device for measuring the volume of the dispensed beer.

7. The beer dispenser of claim 1, wherein the processor is further configured to calculate a volume of the dispensed beer using the at least one image generated by the at least one imaging device.

8. The beer dispenser of claim 1, further comprising at least one of a position sensor for determining a distance between the nozzle and a container bottom and a rim sensor for determining a position of a container rim.

9. The beer dispenser of claim 1, further comprising a second nozzle for dispensing beer into a second container, wherein the nozzle is a first nozzle and the second nozzle dispenses a different beer than the beer dispensed by the first nozzle.

10. The beer dispenser of claim 1, wherein the processor is further configured to:

determine a position of a container rim from the at least one image;

calculate a distance between the container rim and the liquid upper surface; and cease dispensing the beer when the distance between the container rim and the liquid upper surface reaches a threshold.

11. The beer dispenser of claim 1, wherein the at least one imaging device comprises at least one of an ultrasound sensor, an infrared sensor, and a camera.

12. The beer dispenser of claim 1, wherein the processor is further configured to use at least one of a neural network and a computer vision algorithm to determine at least one of the measured foam height and the liquid upper surface.

13. A method for dispensing beer using a beer dispenser, the method comprising:

positioning a nozzle above a container;

dispensing beer from the nozzle into the container;

generating at least one image of the dispensed beer using at least one imaging device;

determining a measured foam height from the at least one image of the dispensed beer;

determining a liquid upper surface from the at least one image of the dispensed beer;

adjusting a distance between the nozzle and the liquid upper surface as the beer is dispensed to control the measured foam height;

determining a difference between the measured foam height and a desired foam height; and adjusting the distance between the nozzle and the liquid upper surface by using an elevation system as the beer is dispensed to reduce the difference between the measured foam height and the desired foam height.

14. The method of claim 13, further comprising using a support to receive the container and adjusting the distance between the nozzle and the liquid upper surface by changing at least one of the position of the support and the nozzle with the elevation system.

15. The method of claim 13, further comprising:

determining a position of a container rim from the at least one image;

calculating a distance between the container rim and the liquid upper surface; and ceasing the dispensing of beer when the distance between the container rim and the liquid upper surface reaches a threshold.

16. The method of claim 13, further comprising generating an image of the dispensed beer using at least one of an ultrasound sensor, an infrared sensor, and a camera.

17. The method of claim 13, wherein the processor uses at least one of a neural network and a computer vision algorithm to determine at least one of the measured foam height and the liquid upper surface.

* * * * *